US012398722B2

(12) United States Patent
Park et al.

(10) Patent No.: US 12,398,722 B2
(45) Date of Patent: Aug. 26, 2025

(54) SCROLL COMPRESSOR

(71) Applicant: LG ELECTRONICS INC., Seoul (KR)

(72) Inventors: Honghee Park, Seoul (KR); Wooyoung Kim, Seoul (KR); Byeonghun Yu, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/588,301

(22) Filed: Feb. 27, 2024

(65) Prior Publication Data

US 2024/0318653 A1 Sep. 26, 2024

(30) Foreign Application Priority Data

Mar. 23, 2023 (KR) ..... 10-2023-0038037

(51) Int. Cl.
*F04C 29/12* (2006.01)
*F04C 18/02* (2006.01)
*F04C 29/00* (2006.01)

(52) U.S. Cl.
CPC ..... *F04C 18/0215* (2013.01); *F04C 18/0261* (2013.01); *F04C 29/0035* (2013.01); *F04C 29/12* (2013.01)

(58) Field of Classification Search
CPC ..... F04C 29/0035; F04C 18/0215; F04C 18/0261; F04C 18/0246; F04C 18/0253; F04C 29/12
See application file for complete search history.

(56) References Cited

U.S. PATENT DOCUMENTS 4,506,423 A * 3/1985 Nakamura ..... F25B 41/30 251/126
10,527,041 B2 * 1/2020 Moon ..... F04C 29/028
(Continued)

FOREIGN PATENT DOCUMENTS

CN 113931842 A * 1/2022 ..... F04C 18/02
JP 2020-033881 3/2020
(Continued)

OTHER PUBLICATIONS

English translation of CN 113931842 by PE2E Jun. 21, 2024.*
Korean Office Action dated Jul. 22, 2024 issued in Application No. 10-2023-0038037.

*Primary Examiner* — Deming Wan
(74) *Attorney, Agent, or Firm* — KED & ASSOCIATES

(57) ABSTRACT

A scroll compressor is provided that may include an orbiting scroll, a non-orbiting scroll, a back pressure chamber assembly, a back pressure passage, and a flow resistance portion. The back pressure passage may provide communication between a compression chamber and a back pressure chamber, and the flow resistance portion may be disposed at a middle portion of the back pressure passage to reduce an amount of refrigerant flowing through the back pressure passage. This may reduce a substantial cross-sectional area of the back pressure passage while improving machining of the back pressure passage, thereby decreasing an amount of refrigerant flowing between the compression chamber and the back pressure chamber. Accordingly, pressure pulsation in the back pressure chamber may be lowered and sealing stability between the orbiting scroll and the non-orbiting scroll may be enhanced, thereby improving compression performance.

14 Claims, 13 Drawing Sheets

(56) References Cited

U.S. PATENT DOCUMENTS

| | | | |
|---|---|---|---|
| 2012/0107163 | A1 | 5/2012 | Monnier et al. |
| 2015/0345493 | A1 | 12/2015 | Lochner et al. |

FOREIGN PATENT DOCUMENTS

| | | |
|---|---|---|
| KR | 10-2018-0094219 | 8/2018 |
| KR | 10-2060475 | 12/2019 |

* cited by examiner

SCROLL COMPRESSOR

CROSS-REFERENCE TO RELATED APPLICATION(S)

Pursuant to 35 U.S.C. § 119(a), this application claims the benefit of the earlier filing date and the right of priority to Korean Patent Application No. 10-2023-0038037, filed in Korea on Mar. 23, 2023, the contents of which are incorporated by reference herein in their entirety.

BACKGROUND

1. Field

A scroll compressor is disclosed herein.

2. Background

A scroll compressor is configured such that an orbiting scroll and a non-orbiting scroll are engaged with each other and a pair of compression chambers is formed between the orbiting scroll and the non-orbiting scroll while the orbiting scroll performs an orbiting motion with respect to the non-orbiting scroll. In the scroll compressor, as the pair of compression chambers is formed, leakage between the compression chambers may be suppressed or prevented only when the non-orbiting scroll and the orbiting scroll are sealed in close contact in an axial direction. Thus, the scroll compressor employs a back pressure structure which presses the orbiting scroll toward the non-orbiting scroll or presses the non-orbiting scroll toward the orbiting scroll. The former may be defined as an orbiting back pressure type, and the latter may be defined as a non-orbiting back pressure type.

The orbiting back pressure type is applied to a structure in which the non-orbiting scroll is fixed to a main frame. In the orbiting back pressure type, a back pressure chamber is formed between the orbiting scroll and the main frame supporting the orbiting scroll. The non-orbiting back pressure type is applied to a structure in which the non-orbiting scroll is axially movable relative to the main frame. In the non-orbiting back pressure type, a back pressure chamber is formed on a rear surface of the non-orbiting scroll. U.S. Patent Publication No. US 2015/0345493 and U.S. Patent Publication No. US 2012/0107163, which are hereby incorporated by reference, each disclose a non-orbiting back pressure type scroll compressor.

In these non-orbiting back pressure type scroll compressors, as the non-orbiting scroll is pressed toward the orbiting scroll by a pressure in the back pressure chamber, it is advantageous in terms of efficiency of the compressor to maintain a difference between the pressure in the back pressure chamber and a pressure in the compression chamber as constantly as possible. This is especially true in low load operating conditions (or a low pressure ratio operation) in which a suction pressure of the compression chamber is lowered. Thus, a back pressure control device is required to change the pressure in the back pressure chamber in response to the pressure in the compression chamber.

In these related art scroll compressors, however, it is advantageous to lower pulsation pressure of the back pressure chamber and reduce a dead volume by making an area of the back pressure passage that connects the compression chamber and the back pressure chamber as small as possible, but there are limits to reduction in the area of the back pressure passage due to machining characteristics. As a result, an amount of refrigerant flowing into or flowing out of the back pressure chamber may increase. This may cause not only an increase in pulsation pressure of the back pressure chamber, but also an increase in area of the back pressure passage, thereby increasing the dead volume.

BRIEF DESCRIPTION OF THE DRAWINGS

Embodiments will be described in detail with reference to the following drawings in which like reference numerals refer to like elements, and wherein.

DETAILED DESCRIPTION

Figure 1:
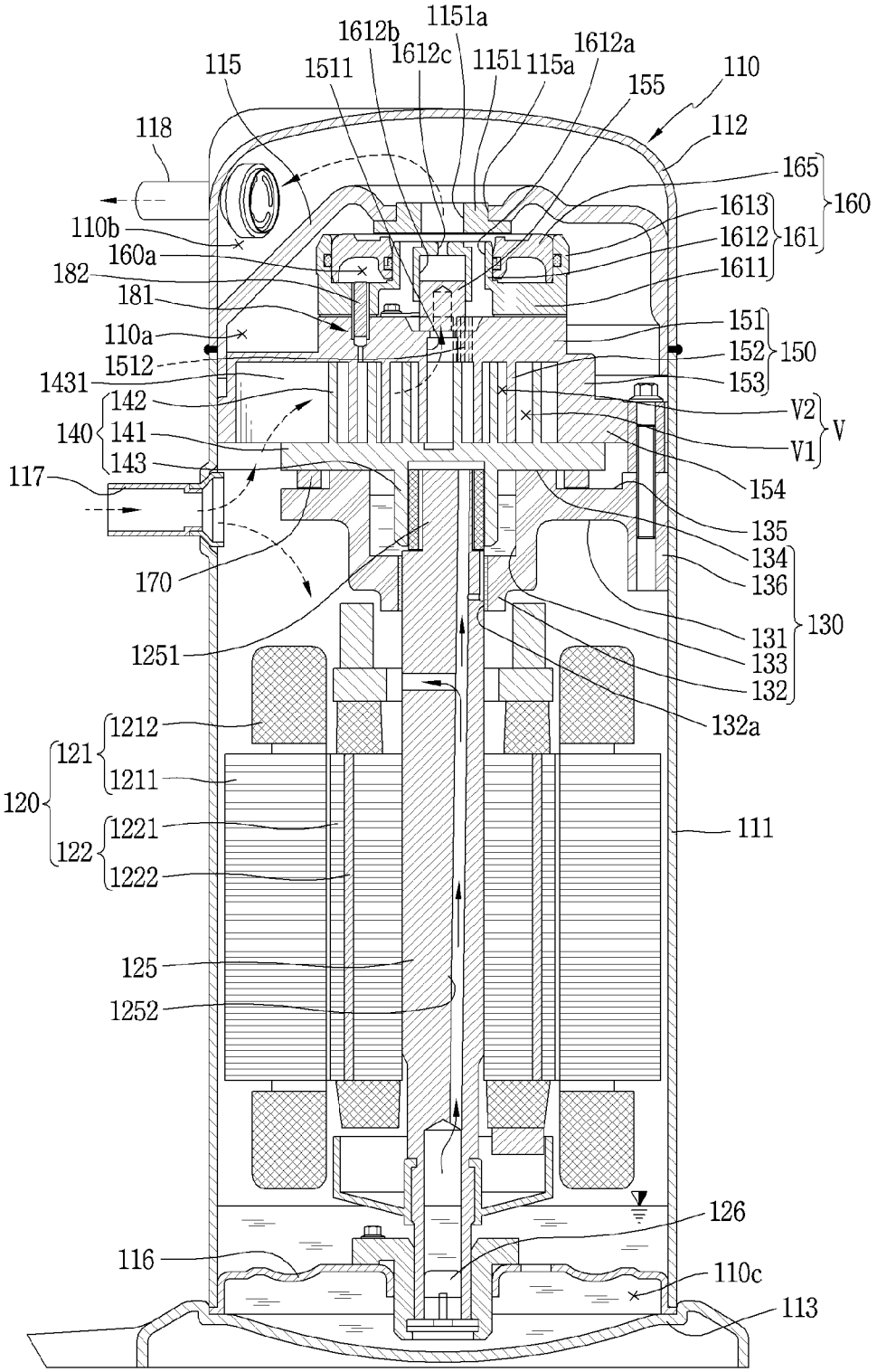
FIG. 1 is a longitudinal cross-sectional view of an inner structure of a scroll compressor in accordance with an embodiment.

Description will now be given of a scroll compressor according to exemplary embodiments disclosed herein, with reference to the accompanying drawings. Wherever possible, the same or like reference numerals have been used to indicate the same or like components, and repetitive disclosure has been omitted.

Typically, a scroll compressor may be classified as an open type or a hermetic type depending on whether a drive unit (motor unit) and a compression unit are all installed in an inner space of a casing. The former is a compressor in which the motor unit configuring the drive unit is provided separately from the compression unit, and the latter hermetic type is a compressor in which both the motor unit and the compression unit are disposed inside of the casing. Hereinafter, a hermetic type scroll compressor will be described as an example, but embodiments are not necessarily limited to the hermetic scroll compressor. In other words, the embodiments may be equally applied even to the open type scroll compressor in which the motor unit and the compression unit are disposed separately from each other.

In addition, scroll compressors may be classified into a vertical scroll compressor in which a rotary shaft is disposed perpendicular to the ground and a horizontal (lateral) scroll compressor in which the rotary shaft is disposed parallel to the ground. For example, in the vertical scroll compressor, an upper side may be defined as an opposite side to the ground and a lower side may be defined as a side facing the ground. Hereinafter, the vertical scroll compressor will be described as an example. However, the embodiments may also be equally applied to the horizontal scroll compressor. Hereinafter, it will be understood that an axial direction is an axial direction of the rotary shaft, a radial direction is a radial direction of the rotary shaft, the axial direction is an upward and downward (or vertical) direction, and the radial direction is a leftward and rightward or lateral direction, respectively.

FIG. 1 is a longitudinal cross-sectional view of an inner structure of a scroll compressor in accordance with an embodiment. Referring to FIG. 1, a scroll compressor according to an embodiment may include a drive motor 120 disposed in a lower half portion of a casing 110, and a main frame 130, an orbiting scroll 140, a non-orbiting scroll 150, and a back pressure chamber assembly 160 that form a compression unit disposed above the drive motor 120. The motor unit is coupled to one or a first end of a rotary shaft 125, and the compression unit is coupled to another or a second end of the rotary shaft 125. Accordingly, the compression unit may be connected to the motor unit by the rotary shaft 125 to be operated by a rotational force of the motor unit.

The casing 110 may include a cylindrical shell 111, an upper cap 112, and a lower cap 113. The cylindrical shell 111 has a cylindrical shape with upper and lower ends open, and the drive motor 120 and the main frame 130 may be fitted on an inner circumferential surface of the cylindrical shell 111. A terminal bracket (not illustrated) may be coupled to an upper half portion of the cylindrical shell 111. A terminal (not illustrated) that transmits external power to the drive motor 120 may be coupled through the terminal bracket. In addition, a refrigerant suction pipe 117 described hereinafter is coupled to the upper portion of the cylindrical shell 111, for example, above the drive motor 120.

The upper cap 112 may be coupled to cover the upper open end of the cylindrical shell 111. The lower cap 113 may be coupled to cover the lower open end of the cylindrical shell 111. A rim of a high/low pressure separation plate 115 described hereinafter may be inserted between the cylindrical shell 111 and the upper cap 112 to be, for example, welded on the cylindrical shell 111 and the upper cap 112. A rim of a support bracket 116 described hereinafter may be inserted between the cylindrical shell 111 and the lower cap 113 to be, for example, welded on the cylindrical shell 111 and the lower cap 113. Accordingly, the inner space of the casing 110 may be sealed.

The rim of the high/low pressure separation plate 115 may be welded on the casing 110 as described above. A central portion of the high/low pressure separation plate 115 may be bent to protrude toward an upper surface of the upper cap 112 so as to be disposed above the back pressure chamber assembly 160 described hereinafter. The refrigerant suction pipe 117 may communicate with a space below the high/low pressure separation plate 115, and a refrigerant discharge pipe 118 may communicate with a space above the high/low pressure separation plate 115. Accordingly, a low-pressure part or portion 110*a* forming a suction space may be formed below the high/low pressure separation plate 115, and a high-pressure part or portion 110*b* of a discharge space may be formed above the high/low pressure separation plate 115.

In addition, a through hole 115*a* may be formed through a center of the high/low pressure separation plate 115. A sealing plate 1151 from which a floating plate 165 described hereinafter may be detachable is inserted into the through hole 115*a*. The low-pressure portion 110*a* and the high-pressure portion 110*b* may be blocked from each other by attachment/detachment of the floating plate 165 and the sealing plate 1151 or may communicate with each other through a high/low pressure communication hole 1151*a* of the sealing plate 1151.

In addition, the lower cap 113 may define an oil storage space 110*c* together with a lower portion of the cylindrical shell 111 forming the low-pressure portion 110*a*. In other words, the oil storage space 110*c* may be defined in a lower portion of the low-pressure portion 110*a*. The oil storage space 110*c* thus defines a part or portion of the low-pressure portion 110*a*.

Referring to FIG. 1, the drive motor 120 according to this embodiment may be disposed in a lower half portion of the low-pressure portion 110*a* and may include a stator 121 and a rotor 122. The stator 121 may be, for example, shrink-fitted to an inner wall surface of the cylindrical shell 111, and the rotor 122 may be rotatably disposed inside of the stator 121.

The stator 121 includes a stator core 1211 and a stator coil 1212. The stator core 1211 may be formed in a cylindrical shape and, for example, shrink-fitted onto the inner circumferential surface of the cylindrical shell 111. The stator coil 1212 may be wound around the stator core 1211 and electrically connected to an external power source through a terminal (not illustrated) that is coupled through the casing 110.

The rotor 122 may include a rotor core 1221 and permanent magnets 1222. The rotor core 1221 may be formed in a cylindrical shape, and rotatably inserted into the stator core 1211 with a preset or predetermined gap therebetween. The permanent magnets 1222 may be embedded in the rotor core 1222 at preset or predetermined intervals along a circumferential direction.

In addition, the rotary shaft 125 is press-fitted to a center of the rotor core 1221. An orbiting scroll 140 described hereinafter may be eccentrically coupled to an upper end of the rotary shaft 125. Accordingly, the rotational force of the drive motor 120 may be transmitted to the orbiting scroll 140 through the rotary shaft 125.

An eccentric portion 1251 that is eccentrically coupled to the orbiting scroll 140 described hereinafter may be formed on an upper end of the rotary shaft 125. An oil pickup 126 that suctions up oil stored in the lower portion of the casing 110 may be disposed in or at a lower end of the rotary shaft 125. An oil passage 1252 may be formed through an inside of the rotary shaft 125 in the axial direction.

Referring to FIG. 1, the main frame 130 may be disposed on an upper side of the drive motor 120, and may be, for example, shrink-fitted to or welded on an inner wall surface of the cylindrical shell 111. The main frame 130 may include a main flange portion 131, a main bearing portion 132, an orbiting space portion 133, a scroll support portion 134, an Oldham ring support portion 135, and a frame fixing portion 136.

The main flange portion 131 may be formed in an annular shape and accommodated in the low-pressure portion 110*a* of the casing 110. An outer diameter of the main flange portion 131 may be smaller than an inner diameter of the cylindrical shell 111 so that an outer circumferential surface of the main flange portion 131 is spaced apart from an inner circumferential surface of the cylindrical shell 111. However, the frame fixing portion 136 described hereinafter may protrude from an outer circumferential surface of the main flange portion 131 in the radial direction. An outer circumferential surface of the frame fixing portion 136 may be fixed in close contact with the inner circumferential surface of the casing 110. Accordingly, the frame 130 may be fixedly coupled to the casing 110.

The main bearing portion 132 may protrude downward from a lower surface of a central part or portion of the main flange portion 131 toward the drive motor 120. A bearing hole 132*a* formed in a cylindrical shape may penetrate through the main bearing portion 132 in the axial direction. The rotary shaft 125 may be inserted into an inner circumferential surface of the bearing hole 132*a* and supported in the radial direction.

The orbiting space portion 133 may be recessed from the center portion of the main flange portion 131 toward the main bearing portion 132 to have a predetermined depth and outer diameter. The outer diameter of the orbiting space portion 133 is larger than an outer diameter of a rotary shaft coupling portion 143 that is disposed on the orbiting scroll 140 described hereinafter. Accordingly, the rotary shaft coupling portion 143 may be pivotally accommodated in the orbiting space portion 133.

The scroll support portion 134 may be formed in an annular shape on an upper surface of the main flange portion 131 along a circumference of the orbiting space portion 133. Accordingly, the scroll support portion 134 may support the lower surface of an orbiting end plate 141 described hereinafter in the axial direction.

The Oldham ring support portion 135 may be formed in an annular shape on an upper surface of the main flange portion 131 along an outer circumferential surface of the scroll support portion 134. Accordingly, an Oldham ring 170 may be inserted into the Oldham ring supporting portion 135 to be pivotable.

The frame fixing portion 136 may extend radially from an outer circumference of the Oldham ring support portion 135. The frame fixing portion 136 may extend in an annular shape or extend to form a plurality of protrusions spaced apart from one another by preset or predetermined distances. This embodiment illustrates an example in which the frame fixing portion 136 has a plurality of protrusions along the circumferential direction.

Referring to FIG. 1, the orbiting scroll 140 according to this embodiment may be coupled to the rotary shaft 125 to be disposed between the main frame 130 and the non-orbiting scroll 150. The Oldham ring 170, which is an anti-rotation mechanism, may be disposed between the main frame 130 and the orbiting scroll 140. Accordingly, the orbiting scroll 140 may perform an orbiting motion relative to the non-orbiting scroll 150 while its rotational motion is restricted.

The orbiting scroll 140 may include an orbiting end plate 141, an orbiting wrap 142, and the rotary shaft coupling portion 143. The orbiting end plate 141 may be formed approximately in a disk shape. An outer diameter of the orbiting end plate 141 may be mounted on the scroll support portion 134 of the main frame 130 to be supported in the axial direction. Accordingly, the orbiting end plate 141 and the scroll support portion 134 facing it defines an axial bearing surface (no reference numeral given).

The orbiting wrap 142 may be formed in a spiral shape by protruding from an upper surface of the orbiting end plate 141 facing the non-orbiting scroll 150 to a preset or predetermined height. The orbiting wrap 142 may be formed to correspond to the non-orbiting wrap 152 to perform an orbiting motion by being engaged with a non-orbiting wrap 152 of the non-orbiting scroll 150 described hereinafter. The orbiting wrap 142 defines compression chambers V together with the non-orbiting wrap 152.

The compression chambers V may include first compression chamber V1 and second compression chamber V2 based on the orbiting wrap 142. Each of the first compression chamber V1 and the second compression chamber V2 includes a suction pressure chamber (not illustrated), an intermediate pressure chamber (not illustrated), and a discharge pressure chamber (not illustrated) that are continuously formed. Hereinafter, description will be given under the assumption that a compression chamber defined between an outer surface of the orbiting wrap 142 and an inner surface of the non-orbiting wrap 152 facing the same is defined as the first compression chamber V1, and a compression chamber defined between an inner surface of the orbiting wrap 142 and an outer surface of the non-orbiting wrap 152 facing the same is defined as the second compression chamber V2.

The rotary shaft coupling portion 143 protrudes from a lower surface of the orbiting end plate 141 toward the main frame 130. The rotary shaft coupling portion 143 may be formed in a cylindrical shape, so that an orbiting bearing (not illustrated) configured as a bush bearing can be press-fitted.

Referring to FIG. 1, the non-orbiting scroll 150 according to this embodiment may be disposed on or at an upper portion of the main frame 130 with the orbiting scroll 140 interposed therebetween. The non-orbiting scroll 150 may be fixedly coupled to the main frame 130 or may be coupled to the main frame 130 to be movable up and down. This embodiment illustrates an example in which the non-orbiting scroll 150 is coupled to the main frame 130 to be movable relative to the main frame 130 in the axial direction.

Referring to FIG. 1, the non-orbiting scroll 150 according to this embodiment may include a non-orbiting end plate portion 151, a non-orbiting wrap 152, a non-orbiting side wall portion 153, and a guide protrusion 154. The non-orbiting end plate portion 151 may be formed in a disk shape and disposed in a lateral direction in the low-pressure portion 110*a* of the casing 110. A discharge port 1511, a bypass hole 1512, and a scroll back pressure hole 1811 defining a portion of the back pressure passage 181 described hereinafter may be formed through a central portion of the non-orbiting end plate portion 151 in the axial direction.

The single discharge port 1511 may be formed such that discharge pressure chambers (no reference numerals given) of both compression chambers V1 and V2 formed at inner and outer sides of the non-orbiting wrap 152 communicate with each other. However, in some cases, the discharge port 1511 may be provided as a plurality to communicate with the compression chambers V1 and V2 independently.

The bypass holes 1512 may independently communicate with the both compression chambers V2. In other words, the bypass hole 1512 may be formed closer to a suction side than the discharge port 1511, and be disposed at one position for each compression chamber V1 and V2. However, in some cases, the bypass holes 1512 may be formed at a plurality of positions for each compression chamber V1 and V2 at predetermined distances along a formation direction of the compression chambers V1 and V2. Although three bypass holes are illustrated in the drawing, hereinafter, it will be defined and described as being formed at one position.

The scroll back pressure hole 1811 may be formed at a position spaced apart from the discharge port 1511 and the bypass holes 1512. In other words, the scroll back pressure hole 1811 may be formed closer to a suction side than the bypass hole 1512. However, in some cases, a portion of the scroll back pressure hole 1811 may be disposed between the discharge port 1511 and the bypass hole 1512. This embodiment shows an example in which the scroll back pressure hole 1811 is formed at a suction side compared to the bypass hole 1512. Accordingly, the discharge port 1511, the bypass hole 1512, and the scroll back pressure hole 1811 may be disposed sequentially from a discharge side to the suction side in the non-orbiting end plate portion 151.

In addition, the scroll back pressure hole 1811 may be formed to communicate with each of both compression chambers V1 and V2, but may alternatively be formed to communicate with only one compression chamber of the compression chambers V1 and V2. This embodiment shows an example in which the scroll back pressure hole is formed to communicate with only one compression chamber of the compression chambers V1 and V2.

Additionally, a flow resistance part or portion 182 and/or a portion of the flow resistance portion 182 may be inserted into the scroll back pressure hole 1811. This embodiment shows an example in which the portion of the flow resistance portion 182 is inserted into the scroll back pressure hole 1811. In other words, the portion of the flow resistance portion 182 may be inserted into the scroll back pressure hole 1811 and a remaining portion of the flow resistance portion 182 may be inserted into the plate back pressure hole 1812. Accordingly, an amount of refrigerant flowing through the back pressure passage 181 configured by the scroll back pressure hole 1811 and the plate back pressure hole 1812 may be reduced. The flow resistance portion 182 will be described hereinafter together with the plate back pressure hole 1812.

The non-orbiting wrap 152 may extend from a compression surface of the non-orbiting end plate 151 facing the orbiting scroll 140 by a preset or predetermined height in the axial direction. The non-orbiting wrap 142 may extend to be spirally rolled a plurality of times toward the non-orbiting side wall portion 153 in a vicinity of the discharge port 1511. The non-orbiting wrap 152 may be formed to correspond to an orbiting wrap 142, so as to define a pair of compression chambers V with the orbiting wrap 142.

The non-orbiting side wall portion 153 may extend in an annular shape from a rim of a compression surface of the non-orbiting end plate 151 in the axial direction to surround the non-orbiting wrap 152. A suction port 1531 may be formed through one side of an outer circumferential surface of the non-orbiting side wall portion 153 in the radial direction.

The guide protrusion 154 may extend radially from an outer circumferential surface of a lower side of the non-orbiting side wall portion 153. The guide protrusion 154 may be formed in a single annular shape or may be provided as a plurality disposed at preset or predetermined distances in the circumferential direction. This embodiment will be mainly described based on an example in which a plurality of guide protrusions 154 is disposed at preset or predetermined distances along the circumferential direction.

Referring to FIG. 1, the back pressure chamber assembly 160 according to this embodiment may be disposed at the rear surface of the non-orbiting scroll 150. Accordingly, a back pressure of the back pressure chamber 160*a* (more specifically, a force that the back pressure acts on the back pressure chamber) is applied to the non-orbiting scroll 150. In other words, the non-orbiting scroll 150 is pressed toward the orbiting scroll 140 by the back pressure to seal both the compression chambers V1 and V2.

The back pressure chamber assembly 160 may include back pressure plate 161 and floating plate 165. The back pressure plate 161 may be coupled to an upper surface of the non-orbiting end plate 151. A floating plate 165 may be slidably coupled to the back pressure plate 161 to define the back pressure chamber 160*a* together with the back pressure plate 161. The back pressure plate 161 may include a fixed plate portion 1611, a first annular wall portion 1612, and a second annular wall portion 1613.

A plate back pressure hole 1812, which communicates with the back pressure chamber 160*a*, may be formed through the fixed plate portion 1611 in the axial direction. The plate back pressure hole 1812 may communicate with the compression chamber V through the scroll back pressure hole 1811. Accordingly, the compression chamber V and the back pressure chamber 160*a* may communicate with each other through the plate back pressure hole 1812 and the scroll back pressure hole 1811.

The plate back pressure hole 1812 may be formed to correspond to the scroll back pressure hole 1811. For example, the plate back pressure hole 1812 may communicate with the scroll back pressure hole 1811. A portion of the flow resistance portion 182 described above may be fixedly inserted into the plate back pressure hole 1812. Accordingly, the amount of refrigerant flowing from the compression chamber V to the back pressure chamber 160*a* may be reduced, thereby reducing not only pressure pulsation in the back pressure chamber 160*a* but also a dead volume in the back pressure passage 181 including the plate back pressure hole 1812. The plate back pressure hole 1812 and the scroll back pressure hole 1811 will be described hereinafter again together with the flow resistance portion 182.

The first annular wall portion 1612 and the second annular wall portion 1613 may be formed on an upper surface of the fixed plate portion 1611 to surround inner and outer circumferential surfaces of the fixed plate portion 1611. Accordingly, the back pressure chamber 160*a* formed in the annular shape is defined by an outer circumferential surface of the first annular wall portion 1612, an inner circumferential surface of the second annular wall portion 1613, the upper surface of the fixed plate portion 1611, and a lower surface of the floating plate 165.

The first annular wall portion 1612 may include an intermediate discharge port 1612*a* that communicates with the discharge port 1511 of the non-orbiting scroll 150. A valve guide groove 1612*b* into which a discharge valve 155 is slidably inserted may be formed at an inner side of the intermediate discharge port 1612*a*. A backflow prevention hole 1612*c* may be formed in a center of the valve guide groove 1612*b*. Accordingly, the discharge valve 155 may be selectively opened and closed between the discharge port 1511 and the intermediate discharge port 1612*a* to suppress or prevent discharged refrigerant from flowing back into the compression chambers V1 and V2.

The floating plate 165 may be formed in an annular shape. The floating plate 165 may be formed of a lighter material than the back pressure plate 161. Accordingly, the floating plate 165 may be detachably coupled to a lower surface of the high/low pressure separation plate 115 while moving in the axial direction with respect to the back pressure plate 161 depending on the pressure of the back pressure chamber 160*a*. For example, when the floating plate 165 is brought into contact with the high/low pressure separation plate 115, the floating plate 165 serves to seal the low-pressure portion 110*a* such that the discharged refrigerant is discharged to the high-pressure portion 110*b* without leaking into the low-pressure portion 110*a*.

The scroll compressor according to this embodiment may operate as follows.

That is, when power is applied to the drive motor 120 and a rotational force is generated, the orbiting scroll 140 eccentrically coupled to the rotary shaft 125 performs an orbiting motion relative to the non-orbiting scroll 150 due to the Oldham ring 170. During this process, the first compression chamber V1 and the second compression chamber V2 that continuously move are formed between the orbiting scroll 140 and the non-orbiting scroll 150. The first compression chamber V1 and the second compression chamber V2 are gradually reduced in volume from the suction port (or suction chamber) 1531 to the discharge port (or discharge chamber) 1511 during the orbiting motion of the orbiting scroll 140.

Accordingly, refrigerant is suctioned into the low-pressure portion 110*a* of the casing 110 through the refrigerant suction pipe 117. Some of this refrigerant is suctioned directly into the suction pressure chambers (no reference numerals given) of the first compression chamber V1 and the second compression chamber V2, respectively, while the remaining refrigerant first flows toward the drive motor 120 to cool down the drive motor 120 and then is suctioned into the suction pressure chambers (no reference numerals given).

The refrigerant is compressed while moving along moving paths of the first compression chamber V1 and the second compression chamber V2. The compressed refrigerant partially flows into the back pressure chamber 160*a* formed by the back pressure plate 161 and the floating plate 165 through the scroll back pressure hole 1811 and the plate back pressure hole 1812 before reaching the discharge port 1511. Accordingly, the back pressure chamber 160*a* forms an intermediate pressure.

The floating plate 165 then rises toward the high/low pressure separation plate 115 to be brought into close contact with the sealing plate 1151 provided on the high/low pressure separation plate 115. The high-pressure portion 110*b* of the casing 110 is separated from the low-pressure portion 110*a*, to prevent the refrigerant discharged from each compression chamber V1 and V2 from flowing back into the low-pressure portion 110*a*.

On the other hand, the back pressure plate 161 is pressed down toward the non-orbiting scroll 150 by the pressure of the back pressure chamber 160*a*. The non-orbiting scroll 150 is pressed toward the orbiting scroll 140. Accordingly, the non-orbiting scroll 150 may be brought into close contact with the orbiting scroll 140, thereby preventing the refrigerant inside of both compression chambers from leaking from a high-pressure compression chamber forming an intermediate pressure chamber to a low-pressure compression chamber.

The refrigerant is compressed to a set pressure while moving from the intermediate pressure chamber toward a discharge pressure chamber. This refrigerant moves to the discharge port 1511 and presses the discharge valve 155 in an opening direction. Responsive to this, the discharge valve 155 is pushed up along the valve guide groove 1612*b* by the pressure of the discharge pressure chamber, so as to open the discharge port 1511. The refrigerant in the discharge pressure chamber flows to the high-pressure portion 110*b* through the discharge port 1511 and the intermediate discharge port 1612*a* disposed in the back pressure plate 161.

As described above, in the non-orbiting back pressure type scroll compressor, it is advantageous that the cross-sectional area (or inner diameter) of the back pressure passage 181, which connects the compression chamber V and the back pressure chamber 160*a*, is as small as possible, in terms of reducing dead volume in the back pressure passage 181 as well as pressure pulsation in the back pressure chamber 160*a*. However, there are limits in the reduction of the cross-sectional area due to machining characteristics. This may unnecessarily increase the cross-sectional area of the back pressure passage 181 and thereby increase the pressure pulsation in the back pressure chamber 160*a*, which may cause an increase in friction loss between scrolls or deterioration of compression performance. In addition, as the cross-sectional area of the back pressure passage 181 increases, the dead volume in the back pressure passage 181 may increase, thereby lowering compression efficiency. Accordingly, in this embodiment, the cross-sectional area of the back pressure passage may be minimized by providing the flow resistance portion in the middle of the back pressure passage, thereby lowering the pressure pulsation in the back pressure chamber and reducing the dead volume.

Figure 2:
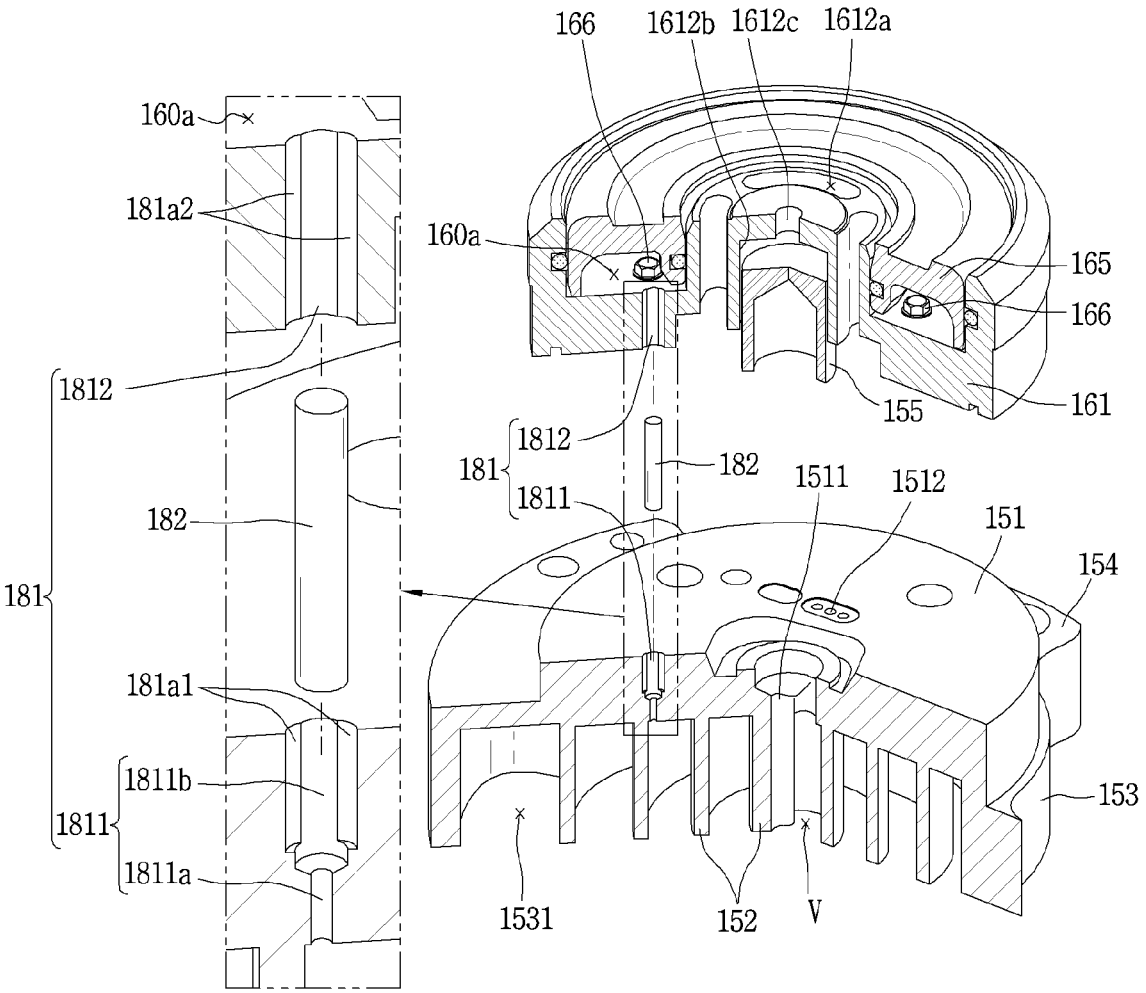
FIG. 2 is an exploded perspective view of a flow resistance portion in FIG. 1 according to an embodiment.
Figure 3:
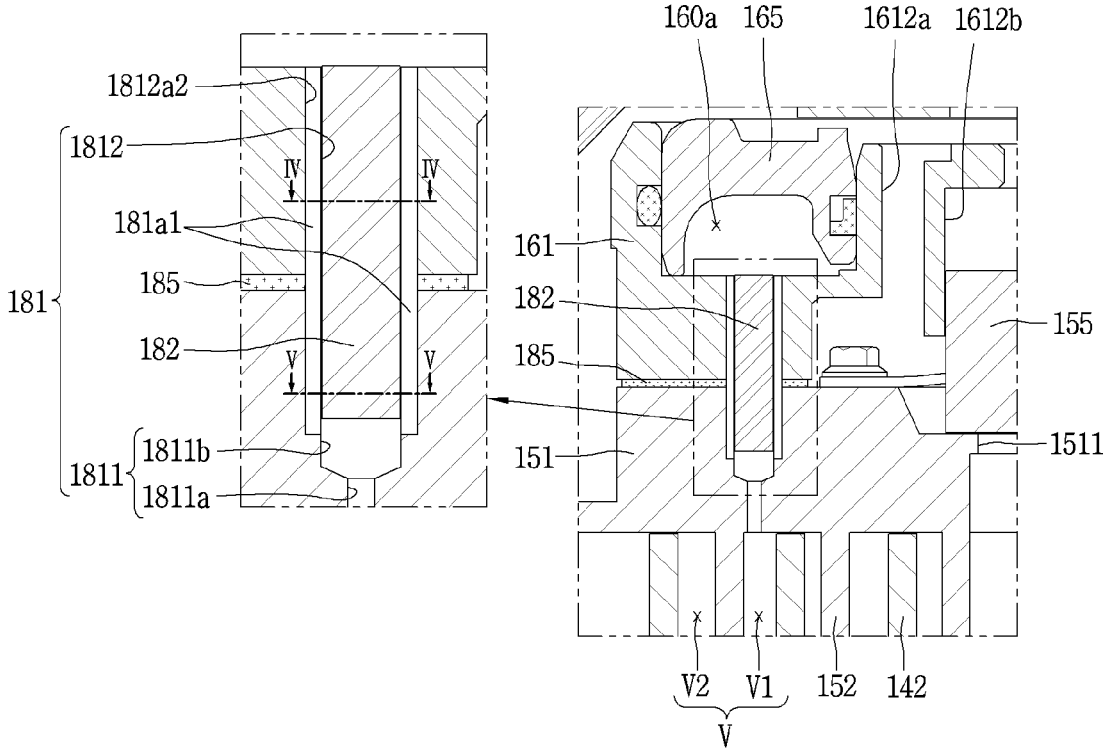
FIG. 3 is an assembled cross-sectional view of the flow resistance portion of FIG. 2.
Figure 4:
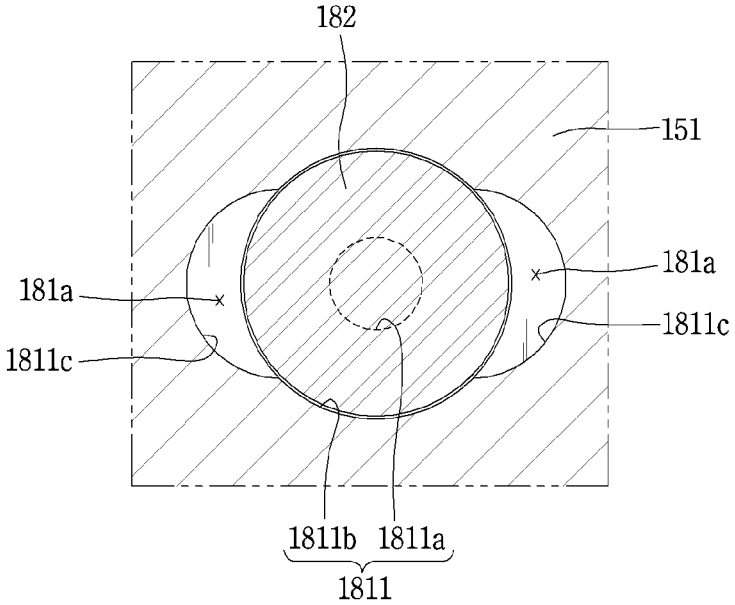
FIG. 4 is a cross-sectional view, taken along line "IV-IV" of FIG. 3.
Figure 5:
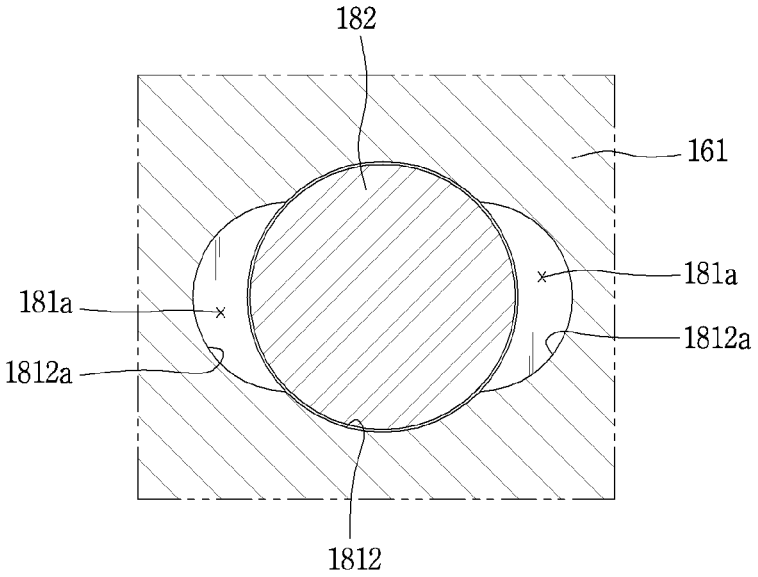
FIG. 5 is a cross-sectional view, taken along line "V-V" of FIG. 3.
Figure 6:
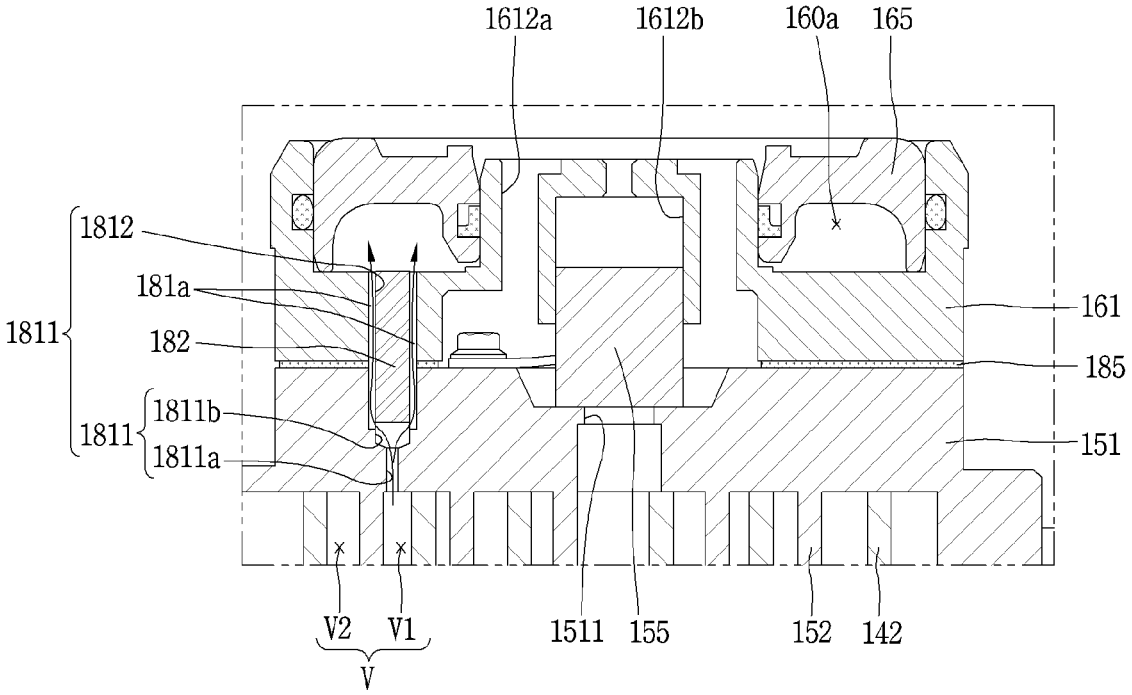
FIG. 6 is a cross-sectional view illustrating refrigerant that passes through a back pressure passage in FIG. 3.

FIG. 2 is an exploded perspective view of a flow resistance portion in FIG. 1 according to an embodiment. FIG. 3 is an assembled cross-sectional view of the flow resistance portion of FIG. 2. FIG. 4 is a cross-sectional view, taken along line "IV-IV" of FIG. 3. FIG. 5 is a cross-sectional view, taken along line "V-V" of FIG. 3, and FIG. 6 is a cross-sectional view illustrating refrigerant that passes through a back pressure passage in FIG. 3.

Referring to FIGS. 2 to 6, in the scroll compressor according to this embodiment, the flow resistance portion 182 may be inserted in the middle of the back pressure passage 181 that connects the compression chamber V and the back pressure chamber 160*a*. The flow resistance portion 182 may be fixedly inserted into the back pressure passage 181. Accordingly, the cross-sectional area of the back pressure passage 181 may be reduced by the cross-sectional area of the flow resistance portion 182, resulting in a great reduction in the actual cross-sectional area of the back pressure passage 181, that is, the cross-sectional area of the refrigerant passage 181*a* between the inner circumferential surface of the back pressure passage 181 and the outer circumferential surface of the flow resistance portion 182. With this structure, the inner diameter of the back pressure passage 181 may increase to improve machining of the back pressure passage 181 and decrease the cross-sectional area of the refrigerant passage 181*a* substantially forming the back pressure passage 181, which may result in reducing the amount of refrigerant flowing through the back pressure passage 181.

The back pressure passage 181 may include a scroll back pressure hole 1811 and a plate back pressure hole 1812. The scroll back pressure hole 1811 and the plate back pressure hole 1812 may communicate with each other, and may be formed so that the flow resistance portion 182, which will be described hereinafter, may be inserted therethrough in the axial direction. Accordingly, the flow resistance portion 182 may be integrally formed, thereby enhancing machining and assembling properties for the flow resistance portion 182.

Referring to FIGS. 2 and 3, the scroll back pressure hole 1811 according to this embodiment may include a small-diameter portion 1811*a* and a large-diameter portion 1811*b*. The small-diameter portion 1811*a* may be a portion which has one end that communicates with the compression chamber V, and the large-diameter portion 1811*b* may be a portion which has a larger inner diameter than the small-diameter portion 1811*a* and into which a lower-half portion of the flow resistance portion 182 is inserted. For example, as illustrated in FIG. 4, the small-diameter portion 1811*a* and the large-diameter portion 1811*b* may be formed on a same axis, but a cross-sectional area of the small-diameter portion 1811*a* may be smaller than a cross-sectional area of the flow resistance portion 182. This may suppress or prevent the flow resistance portion 182 from being pushed toward the compression chamber V even if the pressure of the back pressure chamber 160*a* increases more than the pressure of the compression chamber V.

However, in some cases, the small-diameter portion 1811*a* and the large-diameter portion 1811*b* may be formed on different axes, but may have a same inner diameter. In this case, as a center of the flow resistance portion 182 and a center of the small-diameter portion 1811*a* are located on different axes, separation of the flow resistance portion 182 may be suppressed or prevented even if the small-diameter portion 1811*a* has a large inner diameter.

As illustrated in FIGS. 3 and 4, the cross-sectional area of the large-diameter portion 1811*b* may be larger than the cross-sectional area of the flow resistance portion 182. In other words, a first refrigerant passage groove 1811*c* may be radially recessed into an inner circumferential surface of the large-diameter portion 1811*b*, to be spaced apart from the outer circumferential surface of the flow resistance portion 182. The first refrigerant passage groove 1811*c* may communicate with a second refrigerant passage groove 1812*a*, which will be described hereinafter, to define the refrigerant passage 181*a* between the inner circumferential surface of the back pressure passage 181 and the outer circumferential surface of the flow resistance portion 182. Accordingly, the refrigerant passage 181*a* may communicate with the compression chamber V through the small-diameter portion 1811*a*.

A cross-sectional area of the first refrigerant passage groove 1811*c* may be smaller than or equal to the cross-sectional area of the small-diameter portion 1811*a*. For example, the first refrigerant passage groove 1811*c* may be formed approximately in an arcuate shape on each of both sides of the scroll back pressure hole 1811, and a very narrow radial gap may be defined between an inner circumferential surface of the first refrigerant passage groove 1811*c* and an outer circumferential surface of the flow resistance portion 182. Accordingly, the first refrigerant passage groove 1811*c*, which substantially defines the portion of the back pressure passage 181 between the compression chamber V and the back pressure chamber 160*a*, may have a very small cross-sectional area, thereby reducing the amount of refrigerant flowing between the compression chamber V and the back pressure chamber 160*a*.

Although not shown, the large-diameter portion 1811*b* and the flow resistance portion 182 may have a same cross-sectional area, and a refrigerant passage groove (not illustrated) may be formed in the outer circumferential surface of the flow resistance portion 182 through D-cutting.

Referring to FIGS. 2 and 3, the plate back pressure hole 1812 according to this embodiment may be formed on a same axis as the scroll back pressure hole 1811. The plate back pressure hole 1812 may be formed in the same manner as the large-diameter portion 1811*b* of the scroll back pressure hole 1811. In other words, a second refrigerant passage groove 1812*a* may be formed in an inner circumferential surface of the plate back pressure hole 1812. The second refrigerant passage groove 1812*a* may communicate with the first refrigerant passage groove 1811*c* formed in the inner circumferential surface of the scroll back pressure hole 1811, to form the refrigerant passage 181*a*.

Referring to FIG. 5, the second refrigerant passage groove 1812*a* may be formed in the same manner as the first refrigerant passage groove 1811*c*. Accordingly, even if the flow resistance portion 182 is press-fitted into the plate back pressure hole 1812, the second refrigerant passage groove 1812*a* may be formed between the outer circumferential surface of the flow resistance portion 182 and the plate back pressure hole 1812.

The second refrigerant passage groove 1812*a* may be recessed laterally in the inner circumferential surface of the plate back pressure hole 1812, like the first refrigerant passage groove 1811*c*, and may be extend lengthwise in the axial direction, for example, by a length of the plate back pressure hole 1812. Accordingly, the second refrigerant passage groove 1812*a* may communicate with the first refrigerant passage groove 1811*c* formed between the inner circumferential surface of the scroll back pressure hole 1811 and the outer circumferential surface of the flow resistance portion 182, thereby smoothing the flow of refrigerant between the compression chamber V and the back pressure chambers 160*a*.

A cross-sectional area of the second refrigerant passage groove 1812*a* may be formed as small as possible, for example, to be smaller than the cross-sectional area of the flow resistance portion 182. Accordingly, the cross-sectional area of the refrigerant passage 181*a*, which substantially defines the back pressure passage 181 between the compression chamber V and the back pressure chamber 160*a*, may be decreased, thereby reducing the amount of refrigerant flowing between the compression chamber V and the back pressure chamber 160*a*.

Referring to FIGS. 2 and 3, the flow resistance portion 182 according to this embodiment may be formed in the shape of a pin or rod that extends long and thin in the axial direction. For example, the flow resistance portion 182 may be formed as a long integral body such that one or a first end thereof is inserted into the scroll back pressure hole 1811 while another or a second end is inserted into the plate back pressure hole 1812. Accordingly, the flow resistance portion 182 may extend across from the scroll back pressure hole 1811 to the plate back pressure hole 1812.

However, a length of the flow resistance portion 182 may be set such that the flow resistance portion 182 is spaced apart from the small-diameter portion 1811*a* of the scroll back pressure hole 1811, namely, may be shorter than a length of the back pressure passage 181. Accordingly, a lower end of the flow resistance portion 182 may be spaced apart from the small-diameter portion 1811*a*, to thus suppress or prevent the small-diameter portion 1811*a* from being blocked even if the cross-sectional area of the flow resistance portion 182 is larger than the cross-sectional area of the small-diameter portion 1811*a*.

The cross-sectional area of the flow resistance portion 182 may be constant along the axial direction, but may be larger than the cross-sectional area of the small-diameter portion 1811*a* of the scroll back pressure hole 1811 and smaller than the cross-sectional area of the large-diameter portion 1811*b*. Accordingly, even if the pressure in the back pressure chamber 160*a* increases rapidly, the flow resistance portion 182 may be suppressed or prevented from being separated toward the compression chamber V by being axially supported on a stepped surface between the large-diameter portion 1811*b* and the small-diameter portion 1811*a*.

Although not shown, a press-fitted protrusion (not illustrated) may be formed on a portion of the flow path resistance portion 182, for example, an upper portion forming the second end of the flow resistance portion 182. In other words, the press-fitted protrusion may protrude from an upper-half portion of the outer circumferential surface of the flow resistance portion 182 toward the inner circumferential surface of the plate back pressure hole 1812 in the radial direction. In this case, a length of the press-fitted protrusion may be shorter than the length of the second refrigerant passage groove 1812*a* formed in the inner circumferential surface of the plate back pressure hole 1812. Accordingly, the press-fitted length of the flow resistance portion 182 may be reduced, which may facilitate the flow resistance portion 182 to be press-fitted into the inner circumferential surface of the back pressure passage 181.

Referring to FIG. 6, when the flow resistance portion 182 is inserted into the back pressure passage 181 as described above, the refrigerant passage 181*a*, which is a gap between the inner circumferential surface of the back pressure passage 181 and the outer circumferential surface of the flow resistance portion 182, substantially defines the back pressure passage 181. Accordingly, by appropriately adjusting the gap between the inner circumferential surface of the back pressure passage 181 and the outer circumferential surface of the flow resistance portion 182, the amount of refrigerant flowing between the compression chamber V and the back pressure chamber 160*a* may be appropriately reduced.

Therefore, the amount of refrigerant flowing from the compression chamber V into the back pressure chamber 160*a* or flowing out from the back pressure chamber 160*a* to the compression chamber V may be reduced, thereby lowering pressure pulsation in the back pressure chamber 160*a*. With this structure, the pressure of the back pressure chamber 160*a*, that is, a pressure fluctuation range of back pressure against the non-orbiting scroll 150, may be reduced, and thus, an excessive or insufficient contact between both scrolls 140 and 150 may be suppressed or prevented, thereby improving compression efficiency. In addition, as the flow resistance portion 182 is inserted into the back pressure passage 181, the actual cross-sectional area of the back pressure passage 181 may be reduced and the dead volume due to the back pressure passage 181 may be decreased, thereby improving compression efficiency.

Although not shown, the flow resistance portion 182 may be inserted into only one of the back pressure holes 1811 and 1812 of the scroll back pressure hole 1811 and the plate back pressure hole 1812 defining the back pressure passage 181. In this case as well, the flow resistance portion 182 may be press-fitted into the scroll back pressure hole 1811 or the plate back pressure hole 1812. Also, in this case, the length of the flow resistance portion 182 may be shortened to improve machining and assembling properties.

Hereinafter, description will be given of a flow resistance portion according to another embodiment. That is, in the previous embodiment, the flow resistance portion is formed as an integral body to be press-fitted into the back pressure passage. However, in some cases, the flow resistance portion may be configured as a plurality of separate portions, to be inserted into the scroll back pressure hole and the plate back pressure hole, respectively.

Figure 7:
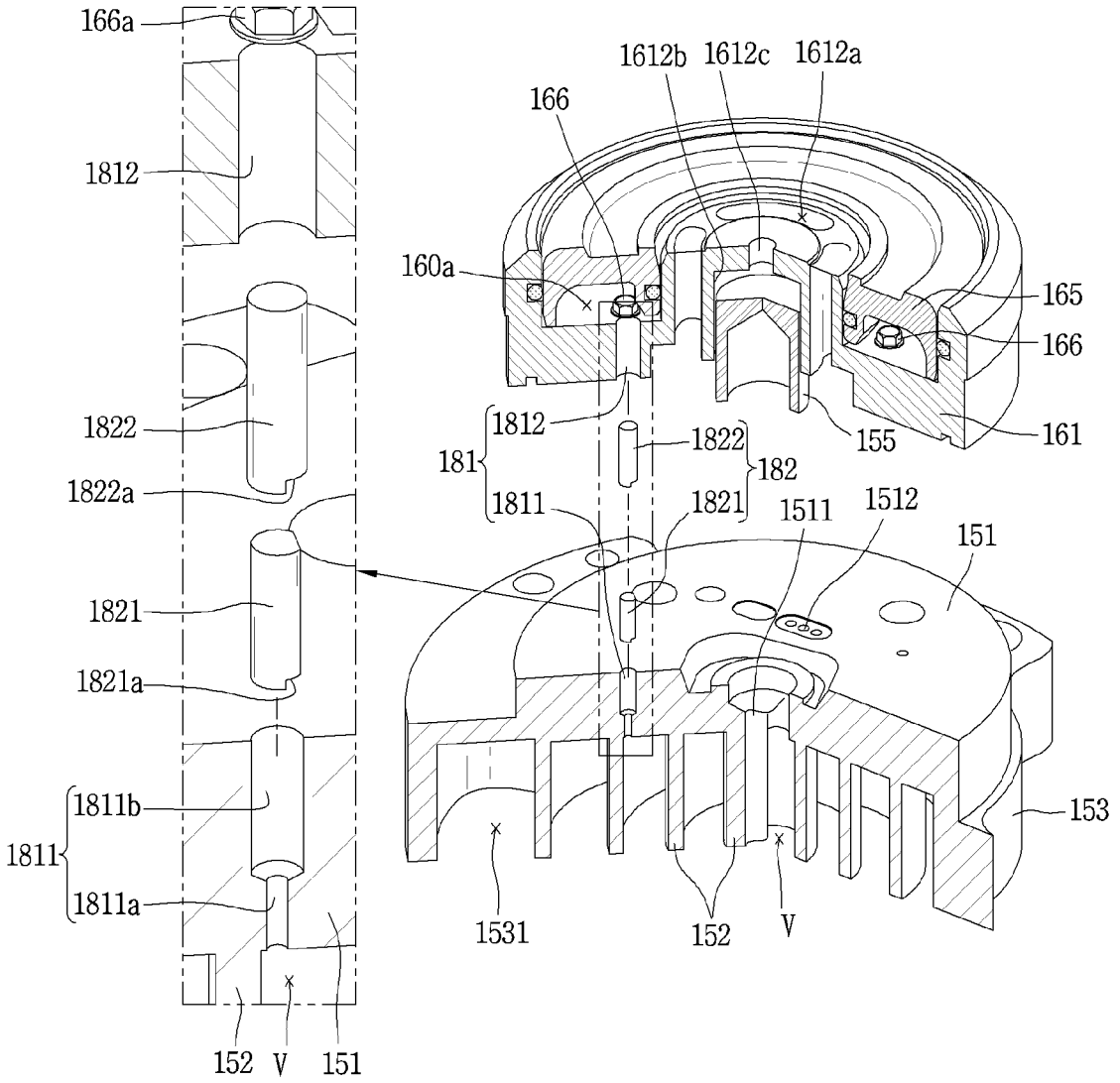
FIG. 7 is an exploded perspective view of a flow resistance portion in FIG. 1 according to another embodiment.
Figure 8:
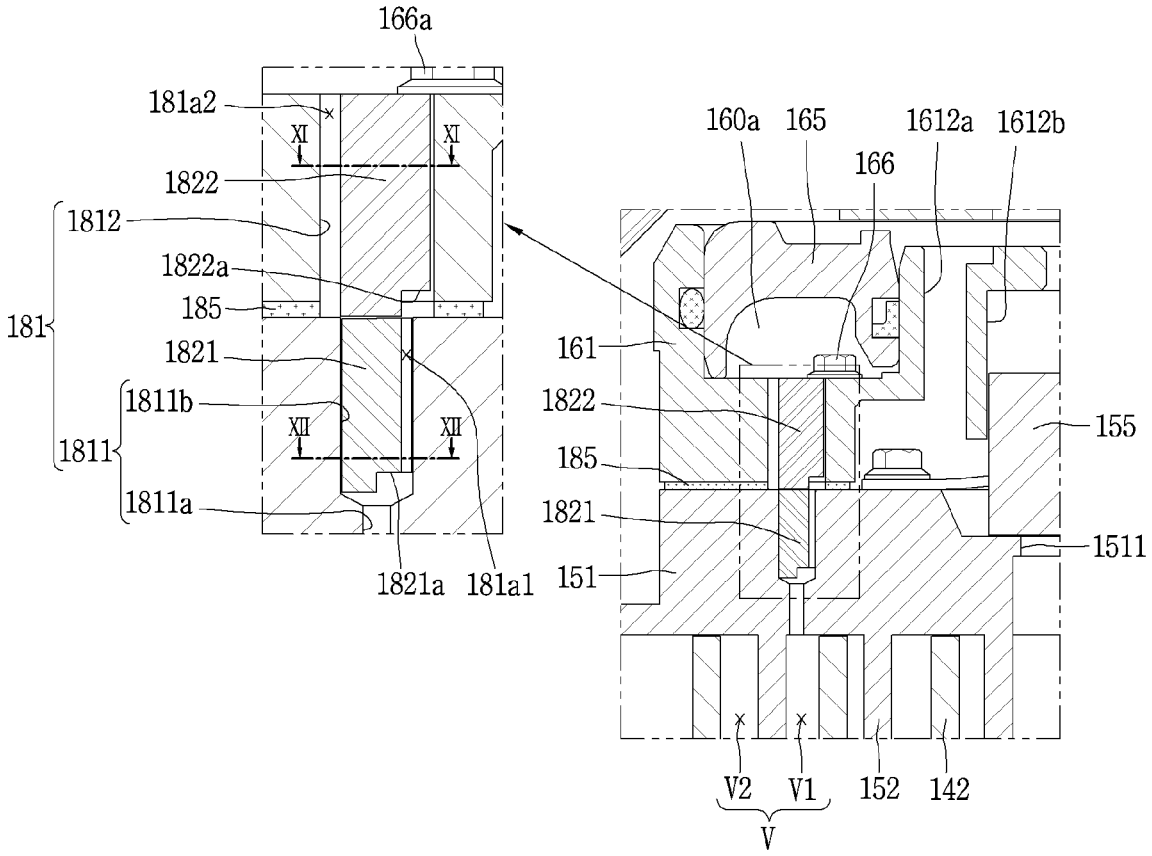
FIG. 8 is an assembled cross-sectional view of the flow resistance portion of FIG. 7.
Figure 9:
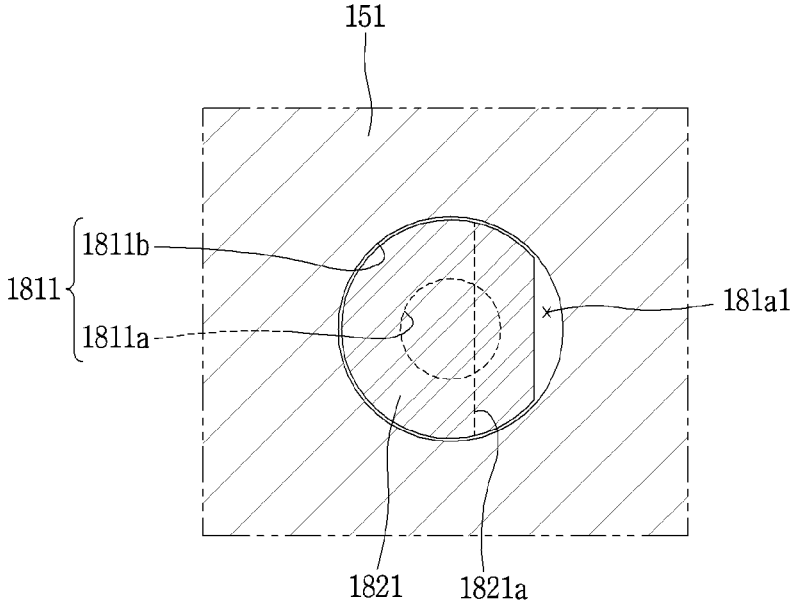
FIG. 9 is a cross-sectional view, taken along line "IX-IX" of FIG. 8.
Figure 10:
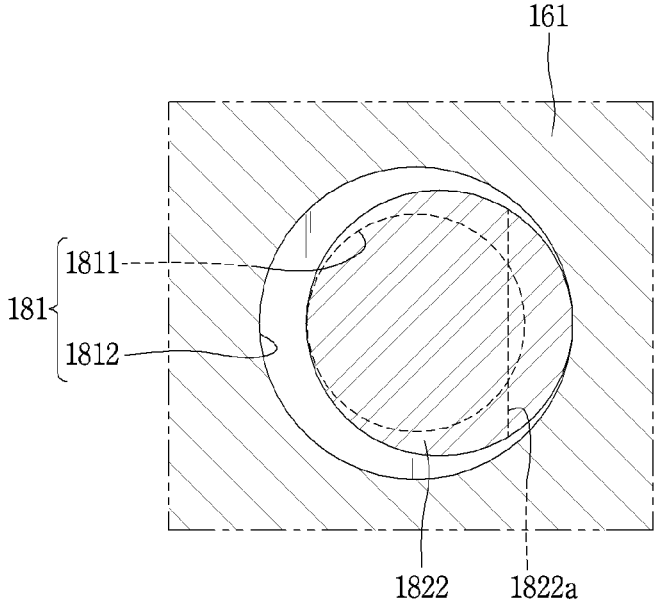
FIG. 10 is a cross-sectional view, taken along line "X-X" of FIG. 8.

FIG. 7 is an exploded perspective view of a flow resistance portion in FIG. 1 according to another embodiment. FIG. 8 is an assembled cross-sectional view of the flow resistance portion of FIG. 7. FIG. 9 is a cross-sectional view, taken along line "IX-IX" of FIG. 8, and FIG. 10 is a cross-sectional view, taken along line "X-X" of FIG. 8.

Referring to FIGS. 7 to 10, the flow resistance portion 182 according to this embodiment may be fixedly inserted into the back pressure passage 181, similar to that in the previous embodiment, but may be divided into a first portion of the flow resistance portion 182 inserted into the scroll back pressure hole 1811 and a second portion inserted into the plate back pressure hole 1812. In other words, the flow resistance portion 182 according to this embodiment may include a first flow resistance portion 1821 and a second flow resistance portion 1822. The first flow resistance portion 1821 is a portion inserted into the scroll back pressure hole 1811, and the second flow resistance portion 1822 is a portion inserted into the plate back pressure hole 1812. Accordingly, machining and/or assembling properties of the back pressure passage 181 and flow resistance portion 182 may be improved. Also, the first passage resistance portion 1821 and the second flow resistance portion 1822 may have different cross-sectional areas to further narrow the refrigerant passage 181*a*.

More specifically, the scroll back pressure hole 1811, similar to that in the previous embodiment, may include small-diameter portion 1811*a* and a large-diameter portion 1811*b*, but first refrigerant passage 181*a*1 may be defined between the inner circumferential surface of the large-diameter portion 1811*b* and the outer circumferential surface of the first flow resistance portion 1821 to communicate with the small-diameter portion 1811*a*. For example, as illustrated in FIG. 9, the outer circumferential surface of the first flow resistance portion 1821 may be D-cut along the axial direction, to define the first refrigerant passage 181*a*1 between the outer circumferential surface of the first flow resistance portion 1821 and the inner circumferential surface of the large-diameter portion 1811*b* facing it. Accordingly, refrigerant in the compression chamber V may flow toward the back pressure chamber 160*a* through the small-diameter portion 1811*a* and the first refrigerant passage 181*a*1, or refrigerant in the back pressure chamber 160*a* may flow toward the compression chamber V through the first refrigerant passage 181*a*1 and the small-diameter portion 1811*a*.

Although not shown, the first refrigerant passage 181*a*1 may alternatively be defined by decreasing the cross-sectional area of the first flow resistance portion 1821 to be smaller than the cross-sectional area of the large-diameter portion 1811*b*.

The cross-sectional area of the first refrigerant passage 181*a*1 may be smaller than or equal to the cross-sectional area of the small-diameter portion 1811*a*. For example, the cross-sectional area of the first refrigerant passage 181*a*1 may be equal to the cross-sectional area of the small-diameter portion 1811*a*. Accordingly, the cross-sectional area of the refrigerant passage 181*a*, which substantially defines the back pressure passage 181 between the compression chamber V and the back pressure chamber 160*a*, may be decreased, thereby reducing the amount of refrigerant flowing between the compression chamber V and the back pressure chamber 160*a*. In addition, flow resistance between the small-diameter portion 1811*a* and the first refrigerant passage 181*a*1 may be minimized to enable a smooth flow of refrigerant.

In addition, a first communication groove 1821*a* stepped in the axial direction may be formed in one end of the first flow resistance portion 1821 facing the small-diameter portion 1811*a*, and the first communication groove 1821*a* may communicate with the first refrigerant passage 181*a*1. In other words, the one end of the first flow resistance portion 1821 may be stepped to define the first communication groove 181*a*1 between the small-diameter portion 1811*a* and the first refrigerant passage 181*a*1. Accordingly, even if one end of the first flow resistance portion 1821 is in close contact with the stepped surface between the small-diameter portion 1811*a* and the large-diameter portion 1811*b*, the first flow resistance portion 1821 may not completely block the small-diameter portion 1811*a* but the small-diameter portion 1811*a* and the first refrigerant passage 181*a*1 may communicate with each other through the first communication groove 1821*a*, enabling the flow of refrigerant between the compression chamber V and the back pressure chamber 160*a*.

The plate back pressure hole 1812 may be formed with a single inner diameter, as in the previous embodiment, and a second refrigerant passage 181*a*2 that communicates with the first refrigerant passage 181*a*1 may be defined between the inner circumferential surface of the plate back pressure hole 1812 and the outer circumferential surface of the second flow resistance portion 1822. For example, as illustrated in FIG. 10, the cross-sectional area of the second flow resistance portion 1822 may be smaller than the cross-sectional area of the plate back pressure hole 1812. Accordingly, the outer circumferential surface of the second flow resistance portion 1822 and the inner circumferential surface of the plate back pressure hole 1812 may be spaced apart by the second refrigerant passage 181*a*2, so that the refrigerant in the compression chamber V may flow toward the back pressure chamber 160*a* through the second refrigerant passage 181*a*2 or the refrigerant in the back pressure chamber 160*a* may flow toward the compression chamber V through the second refrigerant passage 181*a*2.

In this case, the cross-sectional area of the plate back pressure hole 1812 may be larger than the cross-sectional area of the scroll back pressure hole 1811. Accordingly, the first refrigerant passage 181*a*1 and the second refrigerant passage 181*a*2 may smoothly communicate with each other.

Although not shown, the second refrigerant passage 181*a*2, which may be formed by D-cutting the outer circumferential surface of the second flow resistance portion 1822, may extend lengthwise in the axial direction. The cross-sectional area of the second refrigerant passage 181*a*2 may be smaller than or equal to the cross-sectional area of the small-diameter portion 1811*a*. For example, the cross-sectional area of the second refrigerant passage 181*a*2 may be equal to the cross-sectional area of the small-diameter portion 1811*a*. Accordingly, the cross-sectional area of the refrigerant passage groove 181*a*, which substantially defines the back pressure passage 181 between the compression chamber V and the back pressure chamber 160*a*, may be decreased, thereby reducing the amount of refrigerant flowing between the compression chamber V and the back pressure chamber 160*a*. In addition, flow resistance between the first refrigerant passage 181*a*1 and the second refrigerant passage 181*a*2 may be minimized to enable a smooth flow of refrigerant.

In addition, a second communication groove 1822*a* stepped in the axial direction may be formed in one end of the second flow resistance portion 1822 facing the back pressure chamber 160*a*. The second communication groove 1822*a* may communicate with the second refrigerant passage 181*a*2. In other words, the one end of the second flow resistance portion 1822 facing the first flow resistance portion 1821 may be stepped to define the second communication groove 1822*a*. Accordingly, even if the second flow resistance portion 1822 is in close contact with the first flow resistance portion 1821, the first refrigerant passage 181*a*1 and the second refrigerant passage 181*a*2 may not be completely blocked by the second flow resistance portion 1822 but may communicate with each other through the second communication groove 1822*a*, to enable the flow of refrigerant between the compression chamber V and the back pressure chamber 160*a*.

Also, the second flow resistance portion 1822 may be fixed to the back pressure plate 161 by a fastening member 166. For example, as illustrated in FIG. 8, an upper end of the second flow resistance portion 1822 may be pressed by a head portion 166*a* of the fastening member 166, by which the back pressure plate 161 is fastened to the non-orbiting scroll 150, so as to be axially supported. In other words, one or a first end of the second flow resistance portion 1822 may be axially supported by the fastening member 166 and another or a second end by the first flow resistance portion 1821. Accordingly, the first flow resistance portion 1821 and the second flow resistance portion 1822 may be axially fixed between the stepped surface, which is located between the small-diameter portion 1811*a* and the large-diameter portion 1811*b*, and the fastening member 166 in the close contact state in the axial direction. This may allow selection of various materials for the flow resistance portion 182 and facilitate the flow resistance portion 182 to be fixed to the back pressure passage 181 while lowering a degree of machining the flow resistance portion 182.

Although not illustrated, the second flow resistance portion 1822 may alternatively be press-fitted to the inner circumferential surface of the plate back pressure hole 1812. In this case, the second refrigerant passage 181*a*2 may be formed by being recessed laterally in the plate back pressure hole 1812, as in the previous embodiment, or may be D-cut into the outer circumferential surface of the second flow resistance portion 1822.

Referring to FIG. 8, the flow resistance portion 182 may be inserted into the back pressure passage 181 as described above, and when the flow resistance portion 182 is divided into the first flow resistance portion 1821 and the second flow resistance portion 1822, the machining and assembling properties for the flow resistance portion 182 may be improved. For example, in this embodiment, the first flow resistance portion 1821 and the second flow resistance portion 1822 may be assembled after being separately machined. As the second flow resistance portion 1822 serves as a type of stopper, the back pressure passage 181 may be smoothly formed even if the degree of machining the first flow resistance portion 1821 is lowered.

Additionally, in this embodiment, the cross-sectional area of the first refrigerant passage 181*a*1 and the cross-sectional area of the second refrigerant passage 181*a*2 may be different from each other. For example, the first refrigerant passage 181*a*1 between the outer circumferential surface of the first flow resistance portion 1821 and the inner circumferential surface of the scroll back pressure hole 1811 may be narrower than the second refrigerant passage 181*a*2 between the outer circumferential surface of the second flow resistance portion 1822 and the inner circumferential surface of the plate back pressure hole 1812. Accordingly, the substantial cross-sectional area of the back pressure passage 181 may be reduced to lower the flow amount of refrigerant.

Additionally, in this embodiment, the first flow resistance portion 1821 and the second flow resistance portion 1822 may be formed of different materials. For example, the first flow resistance portion 1821 may be made of a material which is more rigid than a material of the second flow resistance portion 1822. This may improve the machining for the flow resistance portion 182 while reducing the cost for the flow resistance portion 182.

Although not shown, in this case as well, the flow resistance portion 182 may be inserted into only one of the back pressure holes 1811 and 1812 of the scroll back pressure hole 1811 or the plate back pressure hole 1812 defining the back pressure passage 181. In this case as well, the flow resistance portion 182 may be inserted into the plate back pressure hole 1812 to be axially supported by the fastening member 166, which is fastened to the back pressure plate 161, or may be inserted into the scroll back pressure hole 1811 to be axially supported by the back pressure plate 161. Also in this case, the length of the flow resistance portion 182 may be shortened, thereby improving machining and assembling properties.

Hereinafter, description will be given of a flow resistance portion according to still another embodiment. That is, in the previous embodiments, the flow resistance portion is inserted into the scroll back pressure hole and/or the plate back pressure hole forming the back pressure passage 181, but in some cases, the flow resistance portion may not be inserted into the scroll back pressure hole and/or the plate back pressure hole but may be formed between the scroll back pressure hole and the plate back pressure hole.

Figure 11:
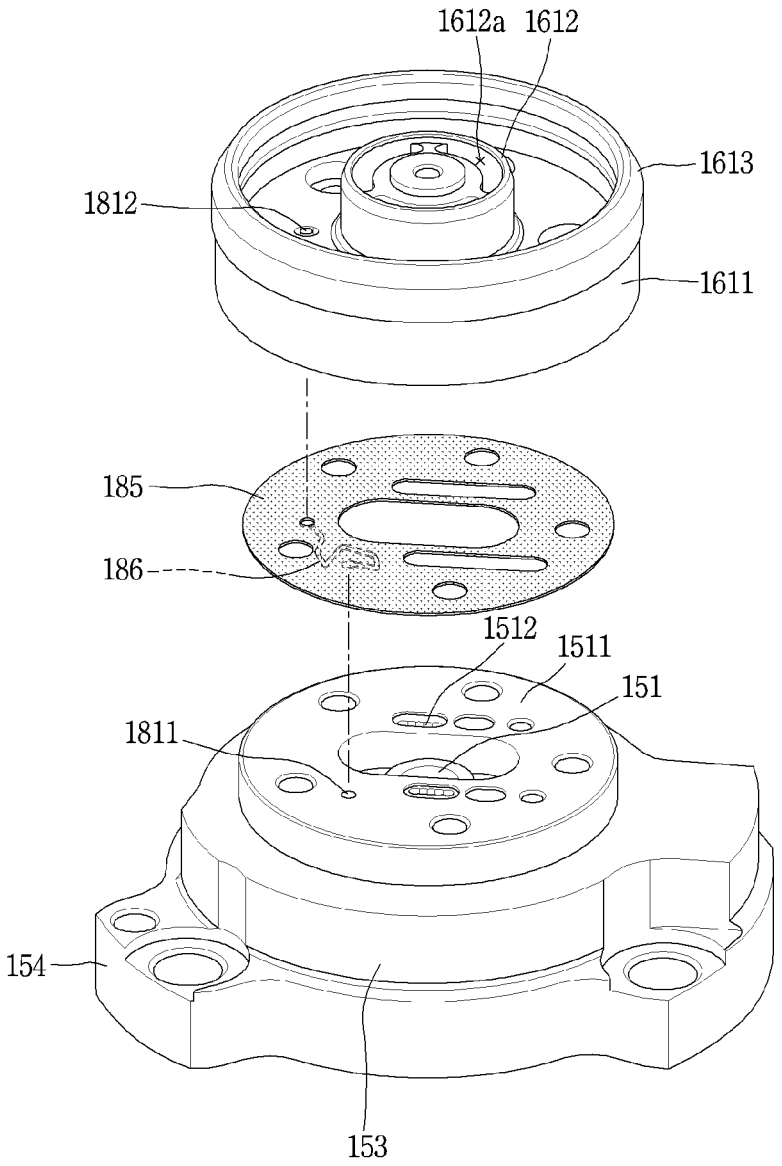
FIG. 11 is an exploded perspective view of a flow resistance portion in FIG. 1 according to still another embodiment.
Figure 12:
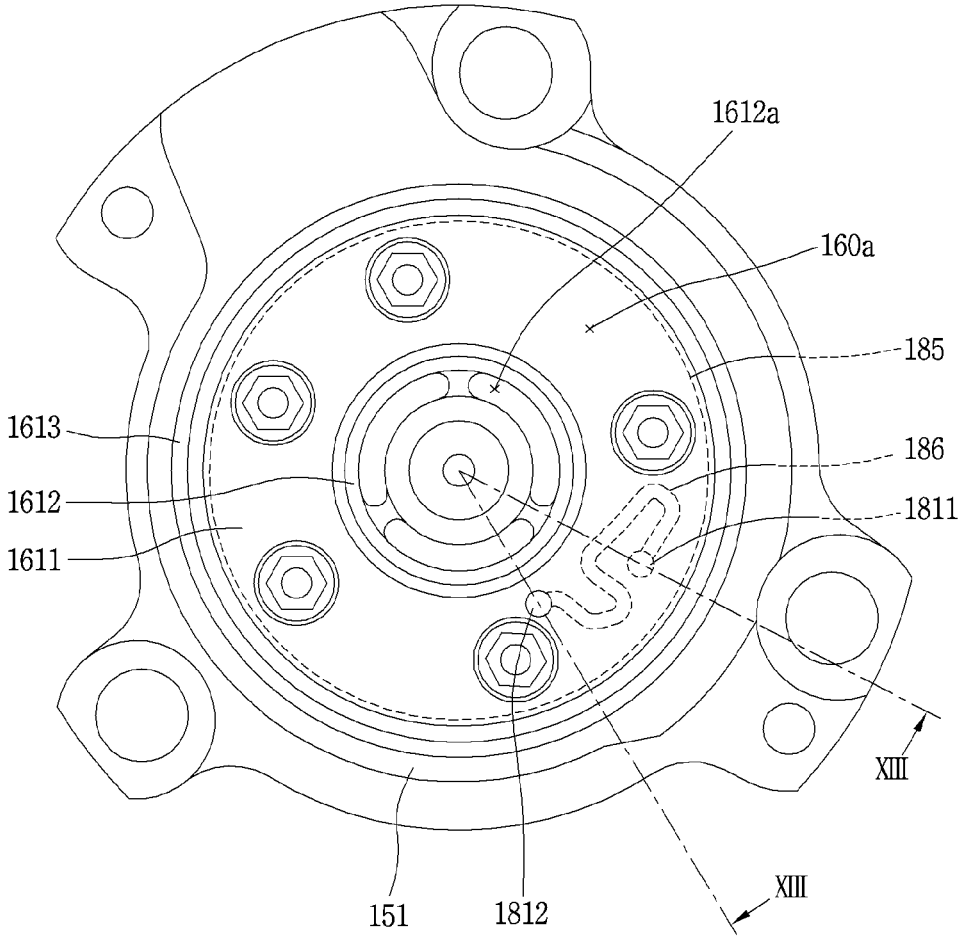
FIG. 12 is an assembled planar view of the flow resistance portion of FIG. 11.
Figure 13:
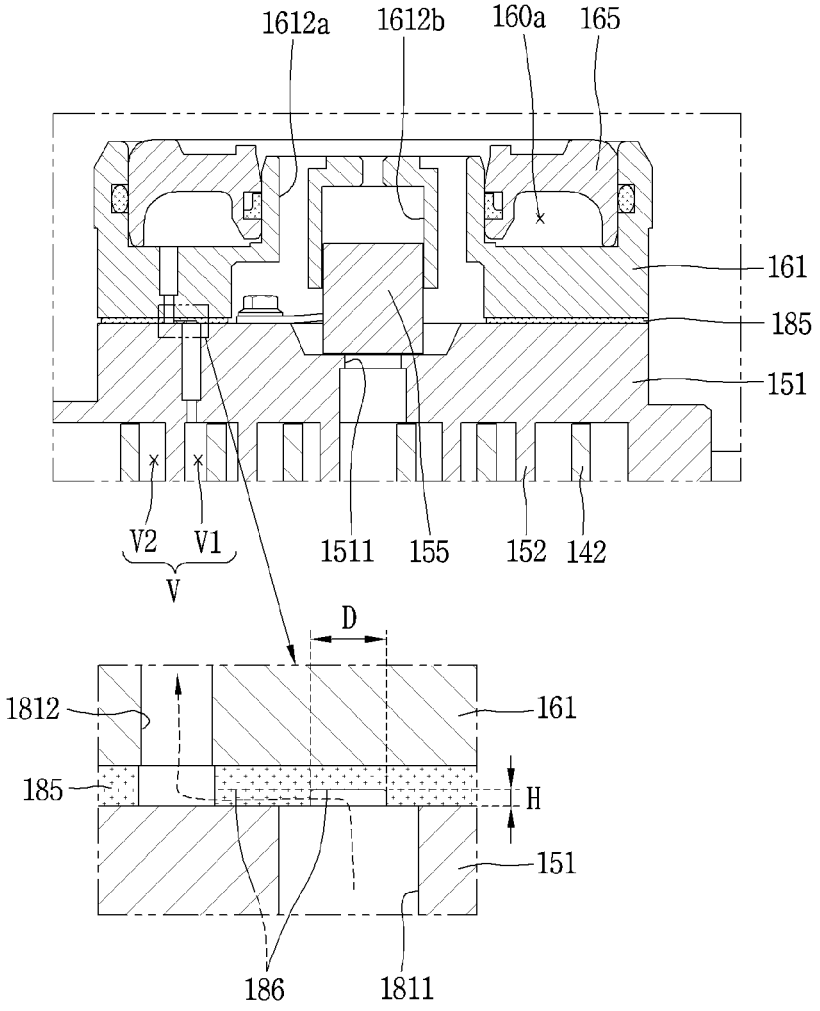
FIG. 13 is a cross-sectional view, taken along line "XIII-XIII" of FIG. 12.

FIG. 11 is an exploded perspective view of a flow resistance portion in FIG. 1 according to still another embodiment. FIG. 12 is an assembled planar view of the flow resistance portion of FIG. 11, and FIG. 13 is a cross-sectional view, taken along line "XIII-XIII" of FIG. 12.

Referring back to FIG. 11, the basic configuration of the scroll compressor according to this embodiment and operating effects thereof are similar to those in the previous embodiments. In other words, in the scroll compressor, the internal space of casing 110 is separated into low-pressure portion 110*a* and high-pressure portion 110*b* by high/low pressure separation plate 115, drive motor 120 is disposed in the low-pressure portion 110*a* of the casing 110, orbiting scroll 140 is coupled to rotary shaft 125 that transmits a rotational force of the drive motor 120, and the orbiting scroll 140 forms compression chamber V with non-orbiting scroll 150 while performing orbiting motion relative to the non-orbiting scroll 150.

In addition, back pressure chamber assembly 160 forming back pressure chamber 160*a* is coupled to a rear surface of the non-orbiting scroll 150, and back pressure passage 181 is formed between the compression chamber V and the back pressure chamber 160*a*. Refrigerant in the compression chamber V flows to the back pressure chamber 160*a* or refrigerant in the back pressure chamber 160*a* flows to the compression chamber 150, to generate back pressure that presses the non-orbiting scroll 150 toward the orbiting scroll 140. Accordingly, the scroll compressor may be implemented as the non-orbiting back pressure type, so that the back pressure chamber 160*a* may be formed as close to the discharge port 1511 as possible, which enables effective suppression or prevention of refrigerant leakage between the compression chambers, thereby improving compression efficiency.

However, as explained in the previous embodiment, it is advantageous to lower pressure pulsation of the back pressure chamber 160*a* and reduce dead volume by forming the cross-sectional area of the back pressure passage 181 as small as possible, but there are limits in reducing the cross-sectional area due to the machining characteristics of the back pressure passage 181. Accordingly, in this embodiment, the substantial cross-sectional area of the back pressure passage 181 may be reduced without inserting a separate flow resistance portion 186 into the back pressure chamber 181 while the pressure pulsation in the back pressure chamber 160*a* may be reduced by lowering the pressure of refrigerant flowing from the compression chamber V to the back pressure chamber 160*a*.

Referring to FIGS. 11 to 13, the flow resistance portion 186 according to this embodiment may be formed in the rear surface of the non-orbiting scroll 150, the rear surface of the back pressure plate 161 facing the rear surface of the non-orbiting scroll 150, or a gasket 185 disposed between the non-orbiting scroll 150 and the back pressure plate 161. In other words, the gasket 185 may be disposed between the rear surface of the non-orbiting scroll 150 and the back pressure plate 161 to seal the discharge port 1511, the bypass hole 1512, and the back pressure passage 181, and the flow resistance portion 186 may be formed in the rear surface of the non-orbiting scroll 150, the rear surface of the back pressure plate 161, and/or the gasket 185. Accordingly, in this embodiment, as the flow resistance portion 186 defines the portion of the back pressure passage 181, it may be understood that the flow resistance portion 186 is disposed in or at a middle of the back pressure passage 181. This embodiment illustrates an example in which the flow resistance portion 186 is disposed in the gasket 185.

For example, the scroll back pressure hole 1811 may be formed in the non-orbiting scroll 150, the plate back pressure hole 1812 may be formed in the back pressure plate 161, and the flow resistance portion 186 that connects the scroll back pressure hole 1811 and the plate back pressure hole 1812 may be formed in the gasket 185. In other words, the scroll back pressure hole 1811 and the plate back pressure hole 1812 may not communicate directly, but may communicate with each other through the flow resistance portion 186 disposed in the gasket 185. Accordingly, as the scroll back pressure hole 1811 and the plate back pressure hole 1812 are formed on different axes, positions of the scroll back pressure hole 1811 and the plate back pressure hole 1812 may be freely adjusted as needed.

The flow resistance portion 186 may be formed through cutting or by being recessed by a preset or predetermined depth between both sides of the gasket 185. This embodiment illustrates an example in which the flow resistance portion 186 is recessed by a preset or predetermined depth so that its axial height H is shorter than its lateral width D. Accordingly, a cross-sectional area of the flow resistance portion 186 may be made as small as possible to increase flow resistance as much as possible.

Additionally, the flow resistance portion 186 may extend along the lateral direction to be formed in a linear shape or a curved shape. This embodiment illustrates an example in which the flow resistance portion 186 is formed in a curved shape. Therefore, the flow resistance portion 186 may be formed as long as possible, thereby increasing flow resistance.

As described above, when the flow resistance portion 186 is formed in the gasket 185 or in the rear surface of the non-orbiting scroll 150 or the rear surface of the back pressure plate 161 facing the gasket 185, the flow resistance portion 186 may be formed even without any separate member, enabling reduction of manufacturing costs. In addition, as the flow resistance portion 186 is formed between the scroll back pressure hole 1811 and the plate back pressure hole 1812, the flow resistance portion 186 may be made as long as possible to increase flow resistance while allowing the scroll back pressure hole 1811 and the plate back pressure hole 1812 to be formed freely on different axes as needed.

In addition, in the previous embodiments, the structure in which the back pressure chamber assembly 160 including the back pressure plate 161 and the floating plate 165 is separately fastened to the rear surface of the non-orbiting scroll 150 has been described, but the embodiments illustrated in FIGS. 2 and 7 may be equally applied even to a case in which the back pressure plate 161 is omitted and the first annular wall portion 1612 and the second annular wall portion 1613 extend as an integral body from the rear surface of the non-orbiting scroll 150.

In addition, as described above, the embodiments may be applied equally to open scroll compressors as well as closed hermetic scroll compressors, applied equally to high-pressure scroll compressors as well as low-pressure scroll compressors, and also applied equally to horizontal scroll compressors as well as vertical scroll compressors.

Embodiments disclosed herein provide a scroll compressor that is capable of lowering pressure pulsation in a back pressure chamber in a non-orbiting back pressure type scroll compressor.

Embodiments disclosed herein further provide a scroll compressor that is capable of reducing an amount of refrigerant flowing between a compression chamber and a back pressure chamber in a non-orbiting back pressure type scroll compressor.

Embodiments disclosed herein furthermore provide a scroll compressor that is capable of facilitating formation of a back pressure passage while reducing a flow amount of refrigerant by forming the back pressure passage to be narrow and long in a non-orbiting back pressure type scroll compressor.

Embodiments disclosed herein also provide a scroll compressor that is capable of reducing a dead volume between a compression chamber and a back pressure chamber in a non-orbiting back pressure type scroll compressor.

Embodiments disclosed herein provide a scroll compressor that may include a casing, an orbiting scroll, a non-orbiting scroll, a back pressure chamber assembly, a back pressure passage, and a flow resistance part or portion. The casing may have a low-pressure part or portion and a high-pressure part or portion. The orbiting scroll may be coupled to a rotary shaft in the low-pressure part of the casing to perform an orbiting motion. The non-orbiting scroll may be engaged with the orbiting scroll to form a compression chamber, and may be movable relative to the orbiting scroll in an axial direction. The back pressure chamber assembly may be disposed on a rear surface of the non-orbiting scroll to form a back pressure chamber. The back pressure passage may be formed such that the compression chamber and the back pressure chamber communicate with each other. The flow resistance part may be disposed in or at a middle portion of the back pressure passage to reduce an amount of refrigerant flowing through the back pressure passage. This may reduce a substantial cross-sectional area of the back pressure passage while improving machining of the back pressure passage, thereby decreasing an amount of refrigerant flowing between the compression chamber and the back pressure chamber. Accordingly, pressure pulsation in the back pressure chamber may be lowered and sealing stability between the orbiting scroll and the non-orbiting scroll may be enhanced, thereby improving compression performance.

The flow resistance part may be inserted into the back pressure passage, and a refrigerant passage may be defined between an inner circumferential surface of the back pressure passage and an outer circumferential surface of the flow resistance portion. The refrigerant passage may have a cross-sectional area smaller than a cross-sectional area of the flow resistance portion. With this structure, the cross-sectional area of the refrigerant passage substantially defining the back pressure passage may be reduced, thereby decreasing an amount of refrigerant flowing through the back pressure passage.

The back pressure passage may include a scroll back pressure hole disposed in the non-orbiting scroll so that one end thereof communicates with the compression chamber, and a plate back pressure hole disposed in the back pressure chamber assembly so that one or a first end thereof communicates with the scroll back pressure hole and another or a second end communicates with the back pressure chamber. The flow resistance part may be inserted across between the scroll back pressure hole and the plate back pressure hole. Accordingly, the flow resistance part may be formed as an integral body, thereby improving machining and assembling properties of the flow resistance part.

For example, the scroll back pressure hole may include a small-diameter portion having one end that communicates with the compression chamber, and a large-diameter portion that extends from another end of the small-diameter portion toward the plate back pressure hole. One or a first end of the flow resistance portion may be inserted into the large-diameter portion, and another or a second end of the flow resistance part may be inserted into the plate back pressure hole. The flow resistance part may have a cross-sectional area that is smaller than a cross-sectional area of the large-diameter portion and larger than a cross-sectional area of the small-diameter portion. With this structure, the cross-sectional area of the refrigerant passage substantially defining the back pressure passage may be reduced, thereby decreasing an amount of refrigerant flowing through the back pressure passage.

More specifically, a refrigerant passage may be defined between an outer circumferential surface of the flow resistance part and an inner circumferential surface of the large-diameter portion. The refrigerant passage may have a cross-sectional area smaller than or equal to a cross-sectional area of the small-diameter portion. With this structure, an amount of refrigerant flowing through the back pressure passage may be decreased by reducing the cross-sectional area of the refrigerant passage, thereby suppressing or preventing pressure fluctuation (pulsation pressure) occurring in the back pressure chamber.

The flow resistance part may be press-fitted to the back pressure passage, and a refrigerant passage groove may be formed to be recessed laterally into an inner circumferential surface of the back pressure passage to be spaced apart from the outer circumferential surface of the flow resistance part. The refrigerant passage groove may have a cross-sectional area that is smaller than a cross-sectional area of the flow resistance part. With this structure, the cross-sectional area of the refrigerant passage substantially defining the back pressure passage between the compression chamber and the back pressure chamber may be reduced, thereby decreasing an amount of refrigerant flowing between the compression chamber and the back pressure chamber.

The back pressure passage may include a scroll back pressure hole disposed in the non-orbiting scroll so that one end thereof communicates with the compression chamber, and a plate back pressure hole disposed in the back pressure chamber assembly so that one or a first end thereof communicates with the scroll back pressure hole and another or a second end communicates with the back pressure chamber. The flow resistance part may include a first flow resistance portion inserted into the scroll back pressure hole, and a second flow resistance portion disposed at one side of the first flow resistance portion in the axial direction at a spacing from the first flow resistance portion, and inserted into the plate back pressure hole. This may improve machining and assembling properties of the back pressure passage and the flow resistance part while the first flow resistance portion and the second flow resistance portion may have different cross-sectional areas to make the refrigerant passage much narrow.

One or a first end of the second flow resistance portion may be disposed to face one end of the first flow resistance portion, and another or a second end of the second flow resistance portion may be fixed to the back pressure chamber assembly. This may facilitate the flow resistance part to be fixed to the back pressure passage.

More specifically, the scroll back pressure hole may include a small-diameter portion having one end that communicates with the compression chamber, and a large-diameter portion that extends from another end of the small-diameter portion toward the plate back pressure hole. A first refrigerant passage may be defined between an outer circumferential surface of the first flow resistance portion and an inner circumferential surface of the large-diameter portion. The first refrigerant passage may have a cross-sectional area smaller than or equal to a cross-sectional area of the small-diameter portion. With this structure, flow resistance between the small-diameter portion and the first refrigerant passage may be minimized to enable a smooth flow of refrigerant.

More specifically, a first communication groove may be formed stepwise in the axial direction in one end of the first flow resistance portion facing the small-diameter portion, and the first communication groove may communicate with the first refrigerant passage. With this structure, even if one end of the first flow resistance portion is in close contact with a stepped surface between the small-diameter portion and the large-diameter portion, the first flow resistance portion does not completely block the small-diameter portion so that refrigerant may smoothly flow between the compression chamber and the back pressure chamber.

Also, a second refrigerant passage may be defined between an outer circumferential surface of the second flow resistance portion and an inner circumferential surface of the plate back pressure hole. The second refrigerant passage may have a cross-sectional area smaller than or equal to the cross-sectional area of the small-diameter portion. With this structure, the cross-sectional area of the second refrigerant passage may be minimized to reduce an amount of refrigerant flowing through the back pressure passage.

More specifically, a second communication groove may be formed stepwise in the axial direction in one end of the second flow resistance portion facing the first flow resistance portion, and the first refrigerant passage and the second refrigerant passage may communicate with the second communication groove. Accordingly, even if the second flow resistance portion is in close contact with the first flow resistance portion, the first refrigerant passage and the second refrigerant passage may communicate with each other through the second communication groove, so that refrigerant may smoothly flow between the compression chamber and the back pressure chamber. In addition, flow resistance between the small-diameter portion and the first refrigerant passage may be minimized to enable a smooth flow of refrigerant.

Also, a cross-sectional area of the plate back pressure hole may be larger than a cross-sectional area of the scroll back pressure hole. Accordingly, the first refrigerant passage and the second refrigerant passage may smoothly communicate with each other.

Additionally, the second flow resistance portion may be supported in the axial direction by a fastening member fastened to the back pressure chamber assembly. This may allow selection of various materials for the flow resistance part, and facilitate the flow resistance part to be fixed to the back pressure passage while lowering a degree of machining the flow resistance part.

A gasket may be disposed between the non-orbiting scroll and the back pressure chamber assembly, and the flow resistance part may extend in a lateral direction from at least one of the non-orbiting scroll, the back pressure chamber assembly, and the gasket. With this structure, the flow resistance part may be formed without an addition of a separate member, thereby reducing manufacturing costs.

The back pressure passage may include a scroll back pressure hole disposed in the non-orbiting scroll so that one end thereof communicates with the compression chamber, and a plate back pressure hole disposed in the back pressure chamber assembly so that one or a first end thereof communicates with the scroll back pressure hole and another or a second end communicates with the back pressure chamber. One or a first end of the flow resistance part may be connected to the scroll back pressure hole, and another or a second end of the flow resistance part may be connected to the plate back pressure hole. Both ends of the flow resistance part may be formed on different axes. This may allow positions of the scroll back pressure hole and the plate back pressure hole to be freely adjusted as needed.

More specifically, the flow resistance part may be formed so that an axial height is smaller than a lateral width. Accordingly, the cross-sectional area of the flow resistance part may be made as small as possible to maximize flow resistance.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing having a low-pressure portion and a high-pressure portion;

an orbiting scroll coupled to a rotary shaft in the low-pressure portion of the casing to perform an orbiting motion;

a non-orbiting scroll engaged with the orbiting scroll to form a compression chamber and movable relative to the orbiting scroll in an axial direction;

a back pressure chamber assembly disposed on a rear surface of the non-orbiting scroll to form a back pressure chamber;

a back pressure passage defined such that the compression chamber and the back pressure chamber communicate with each other; and a flow resistance portion disposed at a middle portion of the back pressure passage to reduce an amount of refrigerant flowing through the back pressure passage, wherein the flow resistance portion is press-fitted into the back pressure passage, wherein at least one refrigerant passage groove is recessed laterally into an inner circumferential surface of the back pressure passage to be spaced apart from an outer circumferential surface of the flow resistance portion, and wherein the at least one refrigerant passage groove has a cross-sectional area that is smaller than a cross-sectional area of the flow resistance portion.

2. The scroll compressor of claim 1, wherein a refrigerant passage is defined between the inner circumferential surface of the back pressure passage and the outer circumferential surface of the flow resistance portion, and wherein the refrigerant passage has a cross-sectional area smaller than the cross-sectional area of the flow resistance portion.

3. The scroll compressor of claim 1, wherein the back pressure passage comprises:

a scroll back pressure hole disposed in the non-orbiting scroll so that one end thereof communicates with the compression chamber; and a plate back pressure hole disposed in the back pressure chamber assembly so that a first end thereof communicates with the scroll back pressure hole and a second end communicates with the back pressure chamber, and wherein the flow resistance portion is inserted across between the scroll back pressure hole and the plate back pressure hole.

4. The scroll compressor of claim 3, wherein the scroll back pressure hole comprises:

a small-diameter portion having a first end that communicates with the compression chamber; and a large-diameter portion that extends from a second end of the small-diameter portion toward the plate back pressure hole, wherein a first end of the flow resistance portion is inserted into the large-diameter portion and a second end of the flow resistance portion is inserted into the plate back pressure hole, and wherein the cross-sectional area of the flow resistance portion is smaller than a cross-sectional area of the large-diameter portion and larger than a cross-sectional area of the small-diameter portion.

5. The scroll compressor of claim 4, wherein a refrigerant passage is defined between the outer circumferential surface of the flow resistance portion and an inner circumferential surface of the large-diameter portion, and wherein the refrigerant passage has a cross-sectional area smaller than or equal to the cross-sectional area of the small-diameter portion.

6. A scroll compressor, comprising:

a casing having a low-pressure portion and a high-pressure portion;

an orbiting scroll coupled to a rotary shaft in the low-pressure portion of the casing to perform an orbiting motion;

a non-orbiting scroll engaged with the orbiting scroll to form a compression chamber and movable relative to the orbiting scroll in an axial direction;

a back pressure chamber assembly disposed on a rear surface of the non-orbiting scroll to form a back pressure chamber;

a back pressure passage defined such that the compression chamber and the back pressure chamber communicate with each other; and a flow resistance portion disposed at a middle portion of the back pressure passage to reduce an amount of refrigerant flowing through the back pressure passage, wherein the back pressure passage comprises:

a scroll back pressure hole disposed in the non-orbiting scroll so that one end thereof communicates with the compression chamber; and a plate back pressure hole disposed in the back pressure chamber assembly so that a first end thereof communicates with the scroll back pressure hole and a second end communicates with the back pressure chamber, and wherein the flow resistance portion comprises:

a first flow resistance portion inserted into the scroll back pressure hole; and a second flow resistance portion disposed at one side of the first flow resistance portion in the axial direction at a spacing from the first flow resistance portion, and inserted into the plate back pressure hole, wherein the scroll back pressure hole comprises:

a small-diameter portion having a first end that communicates with the compression chamber; and a large-diameter portion that extends from a second end of the small-diameter portion toward the plate back pressure hole, wherein a first refrigerant passage is defined between an outer circumferential surface of the first flow resistance portion and an inner circumferential surface of the large-diameter portion, wherein the first refrigerant passage has a cross-sectional area smaller than or equal to a cross-sectional area of the small-diameter portion, wherein a second refrigerant passage is defined between an outer circumferential surface of the second flow resistance portion and an inner circumferential surface of the plate back pressure hole, and wherein the second refrigerant passage has a cross-sectional area smaller than or equal to the cross-sectional area of the small-diameter portion.

7. The scroll compressor of claim 6, wherein a first end of the second flow resistance portion is disposed to face one end of the first flow resistance portion, and a second end of the second flow resistance portion is fixed to the back pressure chamber assembly.

8. The scroll compressor of claim 6, wherein a communication groove is formed stepwise in an axial direction in one end of the first flow resistance portion facing the small-diameter portion, and wherein the communication groove communicates with the first refrigerant passage.

9. The scroll compressor of claim 6, wherein a communication groove is formed stepwise in the axial direction in one end of the second flow resistance portion facing the first flow resistance portion, and wherein the first refrigerant passage and the second refrigerant passage communicate with the communication groove.

10. The scroll compressor of claim 9, wherein the second flow resistance portion is supported in the axial direction by a fastening member fastened to the back pressure chamber assembly.

11. A scroll compressor, comprising:

a casing having a low-pressure portion and a high-pressure portion;

an orbiting scroll coupled to a rotary shaft in the low-pressure portion of the casing to perform an orbiting motion;

a non-orbiting scroll engaged with the orbiting scroll to form a compression chamber and movable relative to the orbiting scroll in an axial direction;

a back pressure chamber assembly disposed on a rear surface of the non-orbiting scroll to form a back pressure chamber;

a back pressure passage defined such that the compression chamber and the back pressure chamber communicate with each other; and a flow resistance portion disposed at a middle portion of the back pressure passage to reduce an amount of refrigerant flowing through the back pressure passage, wherein a gasket is disposed between the non-orbiting scroll and the back pressure chamber assembly, and wherein the flow resistance portion extends in a lateral direction from at least one of the non-orbiting scroll, the back pressure chamber assembly, or the gasket, wherein the back pressure passage comprises:

a scroll back pressure hole disposed in the non-orbiting scroll so that one end thereof communicates with the compression chamber; and a plate back pressure hole disposed in the back pressure chamber assembly so that a first end thereof communicates with the scroll back pressure hole and a second end communicates with the back pressure chamber, wherein a first end of the flow resistance portion is connected to the scroll back pressure hole and a second end of the flow resistance portion is connected to the plate back pressure hole, and wherein ends of the flow resistance portion are on different axes, so that an axial height is smaller than a lateral width.

12. A scroll compressor, comprising:

a casing having a low-pressure portion and a high-pressure portion;

an orbiting scroll coupled to a rotary shaft in the low-pressure portion of the casing to perform an orbiting motion;

a non-orbiting scroll engaged with the orbiting scroll to form a compression chamber and movable relative to the orbiting scroll in an axial direction;

a back pressure chamber assembly disposed on a rear surface of the non-orbiting scroll to form a back pressure chamber;

a back pressure passage defined such that the compression chamber and the back pressure chamber communicate with each other; and a flow resistance portion disposed at a middle portion of the back pressure passage to reduce an amount of refrigerant flowing through the back pressure passage, wherein the flow resistance portion is press-fitted into the back pressure passage, wherein at least one refrigerant passage groove is recessed laterally into an inner circumferential surface of the back pressure passage to be spaced apart from an outer circumferential surface of the flow resistance portion.

13. The scroll compressor of claim 12, wherein the flow resistance portion is inserted into the back pressure passage, wherein a refrigerant passage is defined between the inner circumferential surface of the back pressure passage and the outer circumferential surface of the flow resistance portion, and wherein the refrigerant passage has a cross-sectional area smaller than the cross-sectional area of the flow resistance portion.

14. The scroll compressor of claim 12, wherein the back pressure passage comprises:

a scroll back pressure hole disposed in the non-orbiting scroll so that one end thereof communicates with the compression chamber; and a plate back pressure hole disposed in the back pressure chamber assembly so that a first end thereof communicates with the scroll back pressure hole and a second end communicates with the back pressure chamber, and wherein the flow resistance portion is inserted across between the scroll back pressure hole and the plate back pressure hole.

* * * * *